US009693126B1

(12) United States Patent
Yoon et al.

(10) Patent No.: US 9,693,126 B1
(45) Date of Patent: Jun. 27, 2017

(54) SPEAKER ASSEMBLY AND DISPLAY DEVICE INCLUDING SPEAKER ASSEMBLY

(71) Applicant: LG ELECTRONICS INC., Seoul (KR)

(72) Inventors: Sumin Yoon, Seoul (KR); Brian Chung, Seoul (KR); Youngsung Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/076,734

(22) Filed: Mar. 22, 2016

(30) Foreign Application Priority Data

Dec. 8, 2015 (KR) ..... 10-2015-0173792

(51) Int. Cl.
*H04R 1/02* (2006.01)
*H04R 1/40* (2006.01)

(52) U.S. Cl.
CPC ..... *H04R 1/025* (2013.01); *H04R 1/028* (2013.01); *H04R 1/403* (2013.01); *H04R 2420/07* (2013.01); *H04R 2420/09* (2013.01); *H04R 2499/15* (2013.01)

(58) Field of Classification Search
CPC ..... H04R 1/025; H04R 1/028; H04R 1/403
See application file for complete search history.

(56) References Cited

U.S. PATENT DOCUMENTS 5,833,186 A 11/1998 Kosmoski et al.
8,229,152 B2 7/2012 Sumitani et al.
2005/0201571 A1 9/2005 Saint-Vincent et al.
2006/0147080 A1 7/2006 Wilson et al.
2008/0123894 A1* 5/2008 Lu ..... H04R 1/403 381/394
2008/0240487 A1 10/2008 Lee
2011/0242738 A1 10/2011 Ye
2011/0286613 A1* 11/2011 Lipsky ..... H04R 1/26 381/182
2015/0248846 A1 9/2015 Kang et al.

FOREIGN PATENT DOCUMENTS

KR 20-2000-0012926 7/2000
WO WO 2013/125815 8/2013

OTHER PUBLICATIONS

International Search Report dated Aug. 24, 2016 issued in Application No. PCT/KR2016/002784.
International Search Report dated Aug. 24, 2016 issued in Application No. PCT/KR2016/002785.
U.S. Office Action dated Mar. 23, 2017 issued in co-pending U.S. Appl. No. 15/075,745.

* cited by examiner

*Primary Examiner* — Simon King
(74) *Attorney, Agent, or Firm* — KED & Associates, LLP

(57) ABSTRACT

A speaker assembly and a display device including the speaker assembly are provided. The speaker assembly may include a first speaker, a first connecting portion that is depressed at a side of the first speaker, a first magnetic body provided at the first connecting portion, a second speaker, a second connecting portion that protrudes from a side of the second speaker and configured to be inserted into the first connecting portion, and a second magnetic body provided at the second connecting portion and having a magnetic polarity different from a magnetic polarity of the first magnetic body.

16 Claims, 32 Drawing Sheets

SPEAKER ASSEMBLY AND DISPLAY DEVICE INCLUDING SPEAKER ASSEMBLY

CROSS-REFERENCE TO RELATED APPLICATION

This application claims priority under 35 U.S.C. §119 to Korean Application No. 10-2015-0173792 filed on Dec. 8, 2015, whose entire disclosure is incorporated herein by reference.

BACKGROUND

1. Field

Embodiments relate to a speaker assembly and a display device including the speaker assembly.

2. Background

Various display devices, such as, e.g., liquid crystal displays (LCDs), plasma display panels (PDPs), electroluminescent displays (ELDs), vacuum fluorescent displays (VFDs), and organic light emitting diode (OLED) displays, have been studied and used to meet various demands for the display devices. An OLED display panel may display an image by depositing an organic material layer capable of emitting light on a substrate, at which transparent electrodes may be formed. The OLED display panel may be thin and flexible. Many studies on structural characteristics of display devices including the OLED display panel have been carried out. As display devices may be designed to have a thin or ultrathin profile, a speaker or a speaker assembly suitable for thin or ultrathin profile display devices may be needed. Further, development of technology that expands functions and/or reduces a size of the speaker assembly may extend sound range or provide higher quality sounds.

BRIEF DESCRIPTION OF THE DRAWINGS

The embodiments will be described in detail with reference to the following drawings in which like reference numerals refer to like elements wherein.

DETAILED DESCRIPTION

A display panel 100 may include a first long side, a second long side opposite the first long side, a first short side adjacent to the first long side and the second long side, and a second short side opposite the first short side. The first short side may be referred to as a first side area; the second short side may be referred to as a second side area opposite the first side area; the first long side may be referred to as a third side area which is adjacent to the first side area and the second side area and is positioned between the first side area and the second side area; and the second long side may be referred to as a fourth side area which is adjacent to the first side area and the second side area, is positioned between the first side area and the second side area, and is opposite to the third side area. Embodiments of the disclosure may describe that lengths of the first and second long sides may be longer than lengths of the first and second short sides for the sake of brevity and ease of reading. However, the lengths of the first and second long sides may be almost equal to the lengths of the first and second short sides.

A first direction may be a direction parallel to the long sides of the display panel 100, and a second direction may be a direction parallel to the short sides of the display panel 100. Further, a third direction may be a direction vertical to the first direction and/or the second direction. The first direction and the second direction may be commonly referred to as a horizontal direction, and the third direction may be referred to as a vertical direction. For example, the first direction may be X-axis direction, the second direction may be Y-axis direction, and the third direction may be Z-axis direction.

Figure 1:
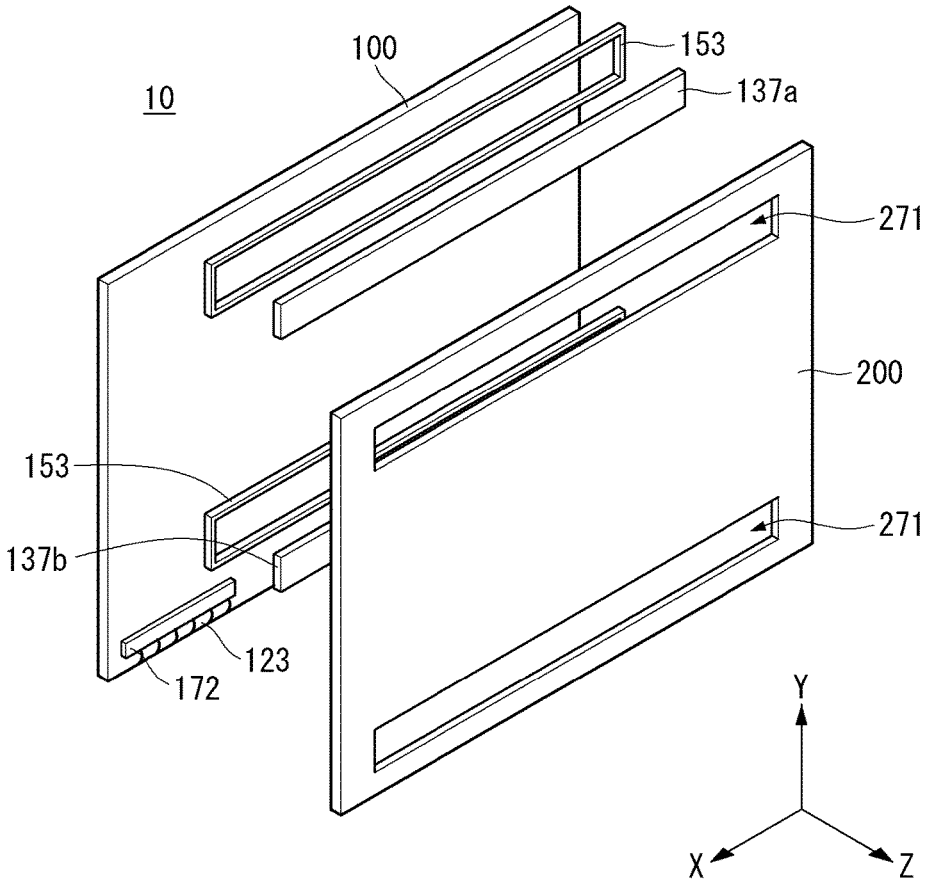
FIG. 1 to FIG. 8B are views of a display device according to an embodiment.

FIGS. 1 to 8 are views of a display device according to an embodiment. Referring to FIG. 1, a body 10 of the display device may include a display panel 100, a bracket 153, a coupling part 137, and a back cover 200. The display panel 100 may be positioned in front of the body 10 and may display an image. The display panel 100 may divide the image into a plurality of pixels and may output the image while controlling color, brightness, and chroma of each pixel. The display panel 100 may have a rectangular shape. Other shapes may be used. For example, the display panel 100 may have a shape having a predetermined curvature at an edge. The display panel 100 may be an OLED display panel. Other display panels may be used. For example, a liquid crystal display panel may be used as the display panel 100.

At least one source printed circuit board (PCB) 172 may be positioned in at least a portion of a back surface of the display panel 100. The source PCBs 172 may be separated from each other. Signal lines for transmitting digital video data and timing control signals received from a timing controller board may be positioned on at least one source PCB 172. The source PCB 172 may be connected to the display panel 100 through a source chip-on film (COF) 123. The source COF 123 connected to one side of the source PCB 172 may extend to a lower surface of the display panel 100 and may be connected to the display panel 100.

The back cover 200 may be provided at a back surface of the display panel 100. The back cover 200 may be directly attached to the display panel 100. The back cover 200 may support the back surface of the display panel 100. The back cover 200 may increase rigidity of the display panel 100. Thus, the back cover 200 may include a lightweight material having high rigidity. For example, the back cover 200 may include aluminum.

A coupling hole 271 may be positioned on each of both sides of the back cover 200. For example, the coupling hole 271 may be positioned on each of an upper side and a lower side of the back cover 200. The coupling holes 271 of the back cover 200 may face each other with respect to the first direction in the middle of the back cover 200. The coupling holes 271 may pass through the back cover 200. Each coupling hole 271 may have a shape extending in the first direction.

The bracket 153 and the coupling part 137 may be positioned between the display panel 100 and the back cover 200. The coupling part 137 may include a magnetic material. The bracket 153 and the coupling part 137 may be positioned at locations corresponding to the coupling holes 271 of the back cover 200. The bracket 153 may have a frame shape, of which a middle portion may be empty. The bracket 153 may increase rigidity of the coupling hole 271 of the back cover 200. Thus, the bracket 153 may be attached to a portion around the coupling hole 271 at a front surface of the back cover 200. The bracket 153 may be configured to surround the coupling hole 271. The bracket 153 may prevent a crack or damage of the coupling hole 271 when the bracket 153 is coupled with the back cover 200. The bracket 153 may include a metal material or a rubber material so as to increase the rigidity of the coupling hole 271. The coupling part 137 may be positioned in at least a portion of the back surface of the display panel 100 corresponding to the coupling hole 271. The coupling part 137 may be positioned in the middle of the bracket 153. The coupling part 137 may be positioned in a portion surrounded by the bracket 153 and the coupling hole 271. However, the embodiment of the disclosure is not limited thereto. For example, the coupling part 137 may get out of a portion corresponding to the bracket 153 and the coupling hole 271.

The coupling part 137 may include a first coupling part 137*a* and a second coupling part 137*b*. The first coupling part 137*a* and the second coupling part 137*b* may be separated from each other. A hook, which will be described later, may be inserted into a separation portion between the first coupling part 137*a* and the second coupling part 137*b*. The first coupling part 137*a* may be positioned at one side of the body 10, and the second coupling part 137*b* may be positioned on the other side opposite the one side of the body 10 with respect to the first direction. The coupling part 137 may include a magnetic material. The coupling part 137 may be attached to the back surface of the display panel 100. The coupling part 137 may be coupled with the display panel 100 through a screw. However, the embodiment of the disclosure is not limited thereto. For example, the coupling part 137 may be coupled with the display panel 100 through an adhesive.

Figure 2:
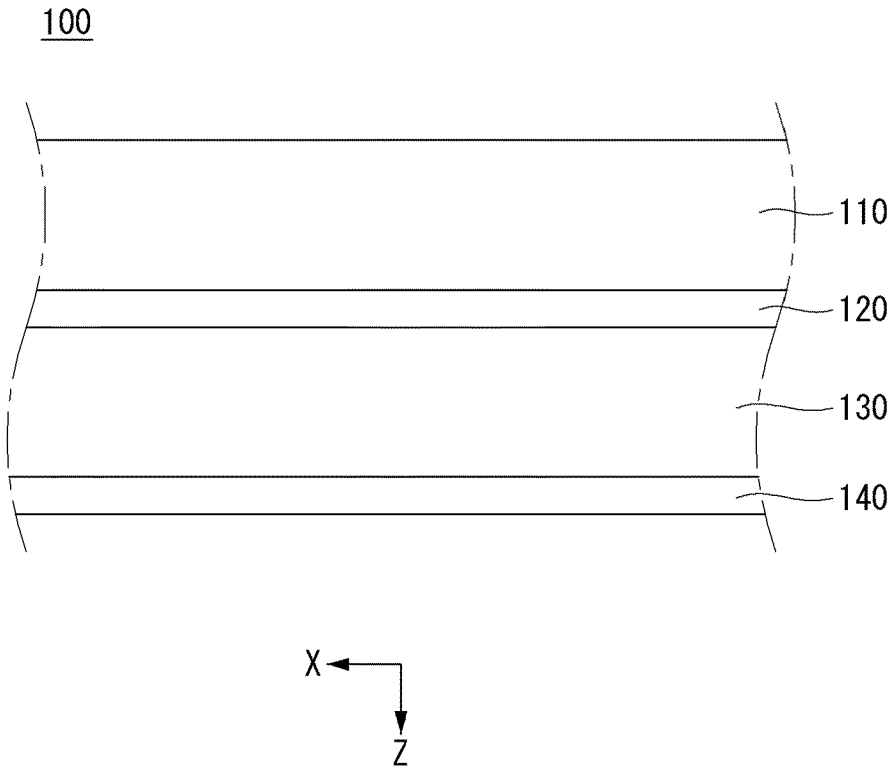

Referring to FIG. 2, the display panel 100 may include a transparent substrate 110, an upper electrode 120, an organic light emitting layer 130, and a lower electrode 140. The transparent substrate 110, the upper electrode 120, the organic light emitting layer 130, and the lower electrode 140 may be sequentially formed. The transparent substrate 110 and the upper electrode 120 may include a transparent material. The lower electrode 140 may include a material which is not transparent, but is not limited thereto. The lower electrode 140 may include a transparent material, for example, indium titanium oxide (ITO). In this instance, light may be emitted from one surface of the lower electrode 140. When a voltage is applied to the upper electrode 120 and the lower electrode 140, light emitted from the organic light emitting layer 130 may pass through the upper electrode 120 and the transparent substrate 110 and may be emitted to an outside. A light shielding plate may be additionally formed behind the lower electrode 140, so as to emit light emitted to the lower electrode 140 to the front.

The display device according to the embodiment may be an OLED display. The OLED display does not require a separate light source, and thus, may reduce a volume and a weight of the display device. Because a response speed of the OLED display is more than 1,000 times a response speed of a liquid crystal display, image retention may not be generated in the OLED display when the OLED display displays an image.

Figure 3A:
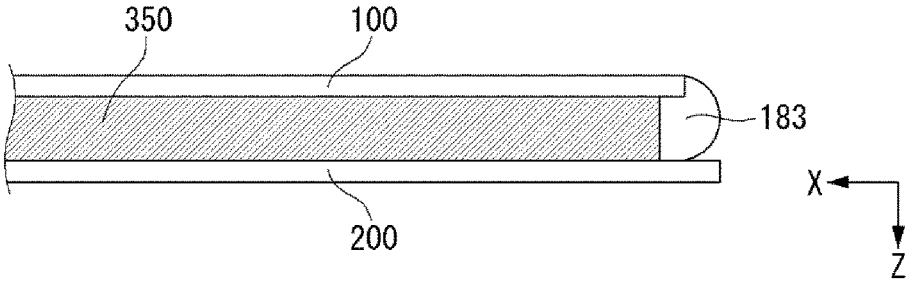

Referring to FIGS. 3A to 3D, the display device according to the embodiment may attach the display panel 100 to the back cover 200 through an adhesive sheet 350. The adhesive sheet 350 may include a double-sided tape, of which both surfaces may be used. The adhesive sheet 350 may have a predetermined thickness. Foreign substances or dust may enter between the display panel 100 and the back cover 200. As shown in FIG. 3A, a sealing member 183 may be sealed to at least one side of the adhesive sheet 350, so as to prevent foreign substances or dust from entering. The sealing member 183 may simultaneously shield the adhesive sheet 350 and at least one side of the display panel 100.

Figure 3B:
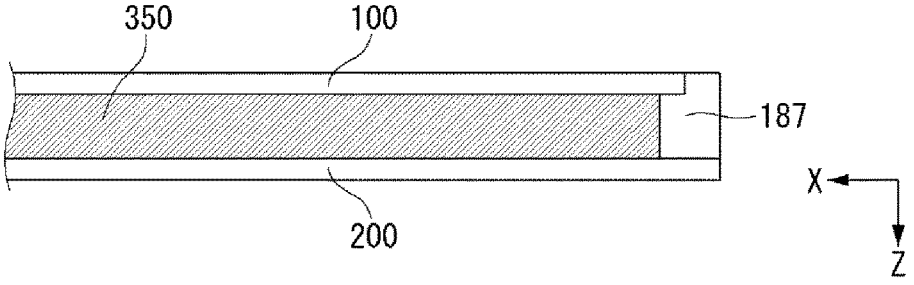

As shown in FIG. 3B, a frame 187 may be inserted into at least one side of the adhesive sheet 350. The frame 187 may adhere to at least one side of the adhesive sheet 350 and may bend so that one end of the frame 187 may extend toward the display panel 100. Thus, the frame 187 may simultaneously shield the adhesive sheet 350 and at least one side of the display panel 100.

Figure 3C:
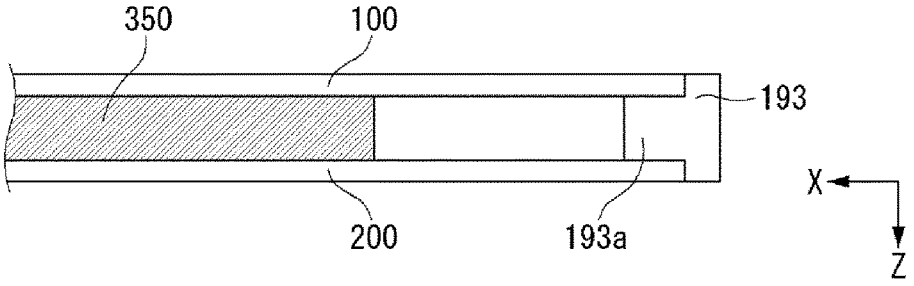

As shown in FIG. 3C, a middle cabinet 193 may be positioned between the display panel 100 and the back cover 200. The middle cabinet 193 may guide a connection location of the display panel 100. A flange 193*a* of the middle cabinet 193 may be inserted between the display panel 100 and the back cover 200. A body of the middle cabinet 193 may simultaneously shield the display panel 100 and at least one side of the back cover 200. The flange 193*a* of the middle cabinet 193 may be separated from the adhesive sheet 350. Thus, because the adhesive sheet 350 is not positioned entirely in the display panel 100, an amount of the adhesive sheet 350 required to manufacture the display device may decrease.

Figure 3D:
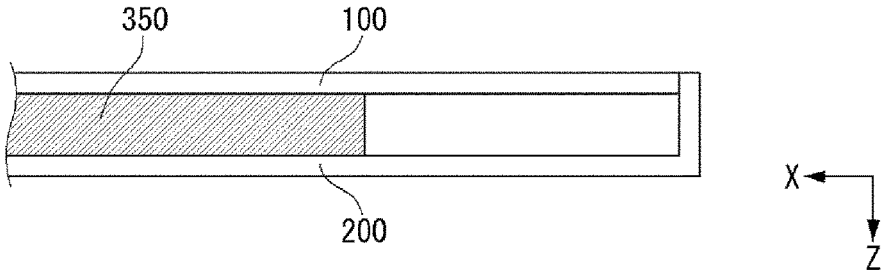

As shown in FIG. 3D, an edge of the back cover 200 may bend toward the display panel 100. Because the edge of the back cover 200 bends, at least one side of the adhesive sheet 350 may be shielded from the outside. In this instance, other materials may not be included between the display panel 100 and the back cover 200. Thus, a process for manufacturing the display device may be simplified, and manufacturing costs may be reduced. Further, the edge of the back cover 200 may be separated from the adhesive sheet 350. Thus, because the adhesive sheet 350 is not positioned entirely in the display panel 100, an amount of the adhesive sheet 350 required to manufacture the display device may decrease. In the following embodiments, description of structures on the side of the adhesive sheet 350 may be briefly made or may be omitted for the sake of brevity and ease of reading. The structures on the side of the adhesive sheet 350 may be applied to other embodiments.

Figure 4A:
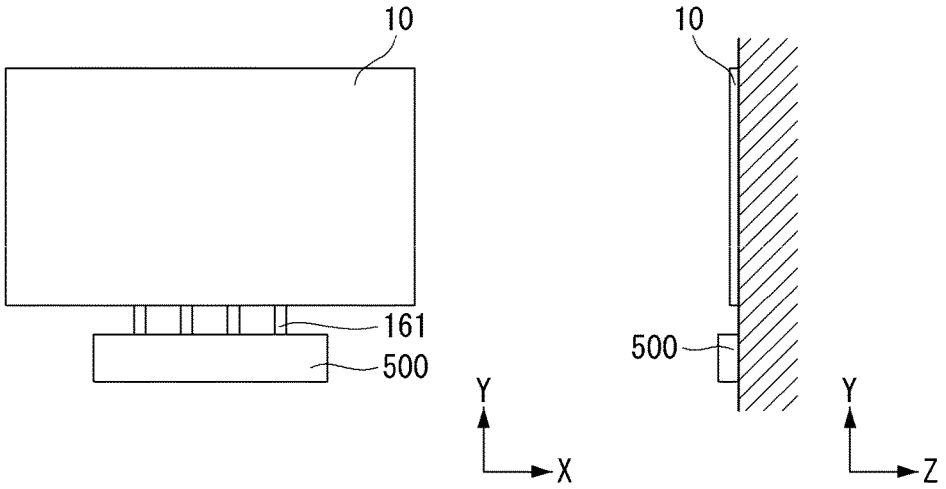
Figure 4B:
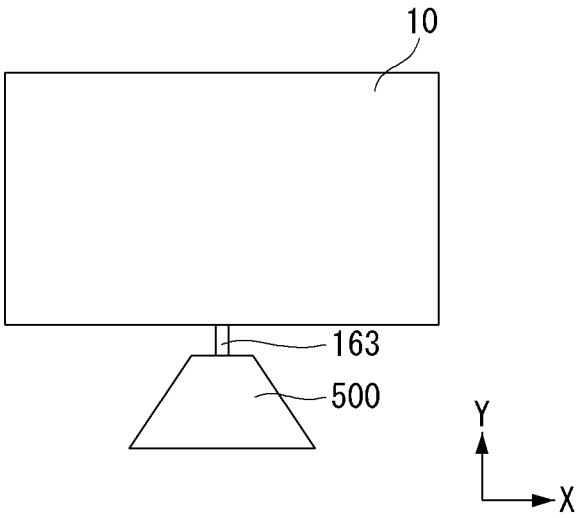
Figure 4C:
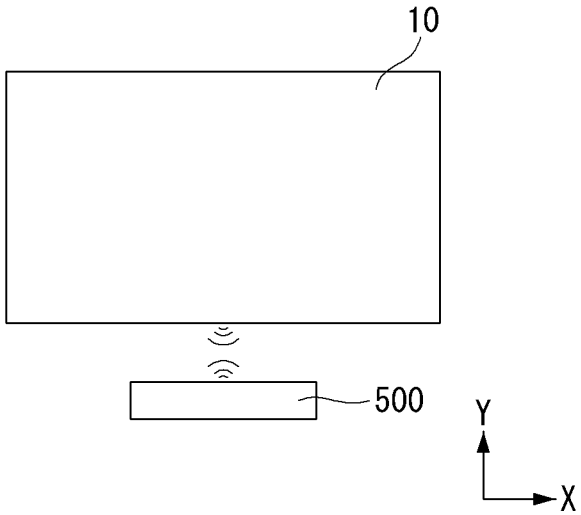

Referring to FIGS. 4A to 4C, the display device according to the embodiment may include a housing 500 electrically connected to the body 10. The body 10 may be referred to as a display head. The housing 500 may transmit at least one signal to the body 10. The housing 500 may shield components that drive the display device. For example, the housing 500 may shield at least one printed circuit board (PCB). The housing 500 may not adhere to the body 10 and may be separated from the body 10. The housing 500 may not be positioned in or at a screen display portion of the display device. Thus, a user may further concentrate on the display screen.

For example, as shown in FIG. 4A, the housing 500 may be connected to the body 10 through a plurality of flat flexible cables (FFCs) 161. The FFC 161 may include a plurality of signal connection terminal pins and at least one ground terminal pin for connecting the housing 500 to the body 10. The FFC 161 may be cheaper than other cables. As shown in FIG. 4B, the housing 500 may be connected to the body 10 through one circular cable 163. Electrical signals may be transmitted through one circular cable 163, unlike in FIG. 4A, in which the electrical signals are transmitted through the plurality of FFCs 161. Because the housing 500 and the body 10 are connected through the one circular cable 163, and not the plurality of FFCs 161, the user may feel that an appearance of the display device may be neater and more attractive.

As shown in FIG. 4C, the housing 500 and the body 10 may exchange electrical signals with each other wirelessly. In this instance, the user may feel that the appearance of the display device may be neater and more attractive than the appearance of the display device, in which the housing 500 and the body 10 are connected through the FFCs 161 or the circular cable 163. The body 10 and the housing 500 may be separated from each other. Thus, the user may further concentrate on the display screen, and also the display device including the thinner body 10 may be implemented.

Figure 5A:
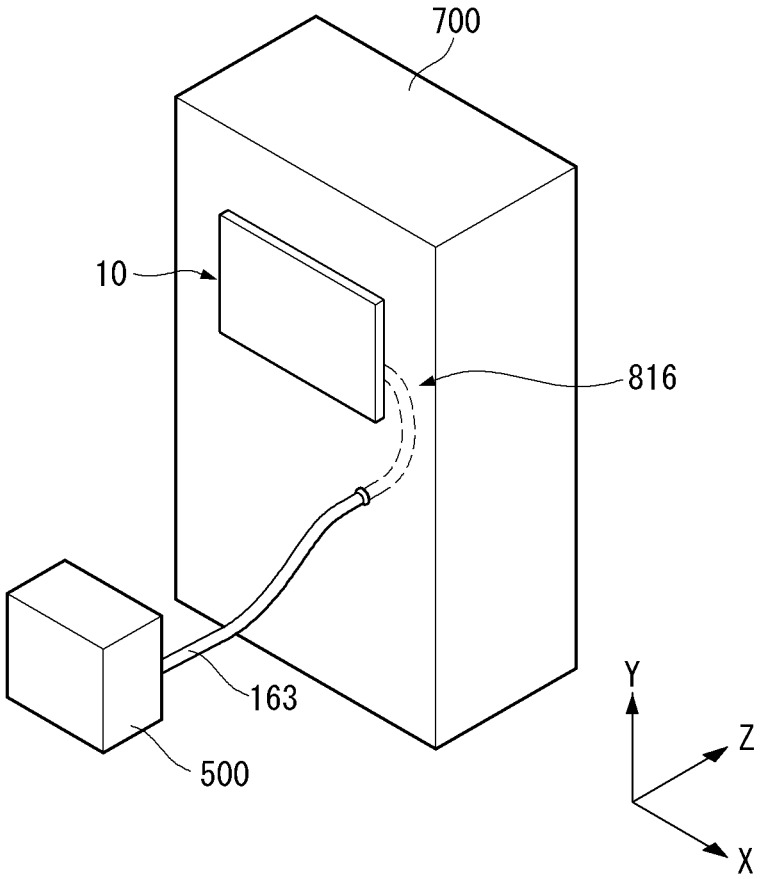
Figure 5B:
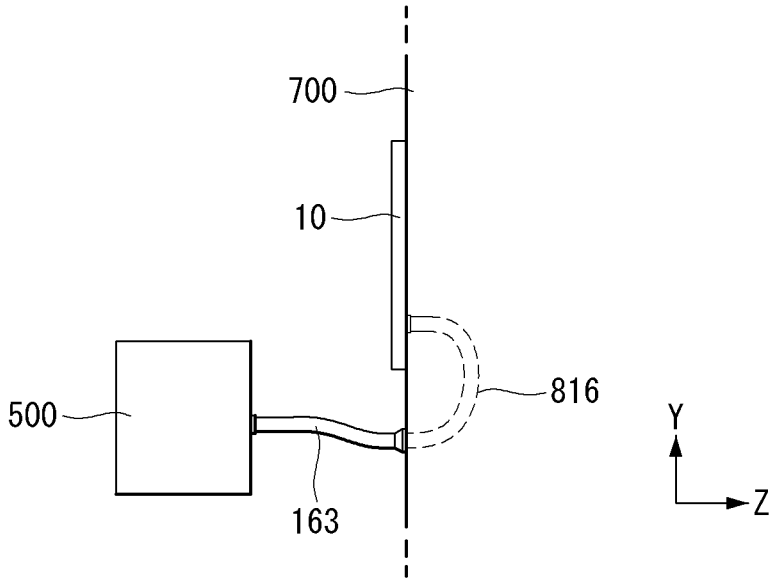

Referring to FIGS. 5A and 5B, the display device according to the embodiment may exchange electrical signals with the housing 500 through electrical wires 816 passing through a surface 700, to which the body 10 may be attached. One side of the source PCB of the body 10 may be connected to the electrical wires 816. The electrical wire 816 may be inserted into a portion of the surface 700, through which the electrical wire 816 passes. One side of the electrical wire 816 may be connected to the source PCB, and another side may be connected to the circular cable 163. The electrical wire 816 may be positioned inside the surface 700 and thus may not be seen by the user.

The display device according to the embodiment may connect the body 10 to the housing 500 through the electrical wire 816 inserted inside the surface 700. Thus, it may look as if the body 10 and the housing 500 are not directly connected. Thus, the user may feel that the appearance of the display device is neater and more attractive, and may further concentrate on the display screen.

Figure 6A:
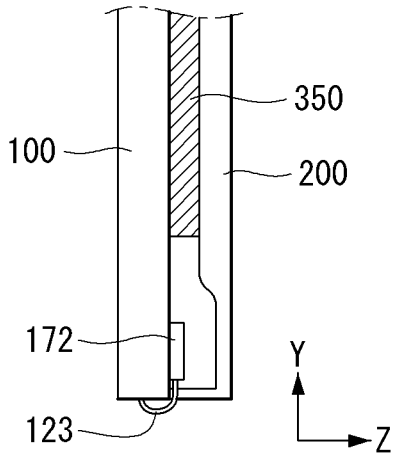
Figure 6B:
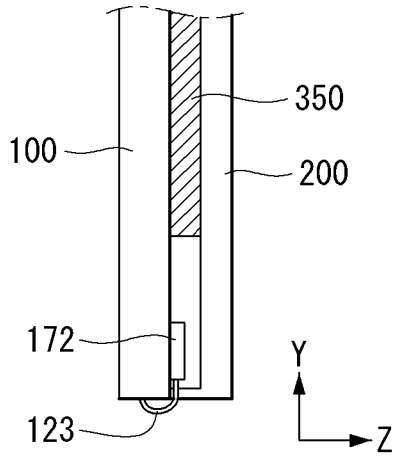
Figure 6C:
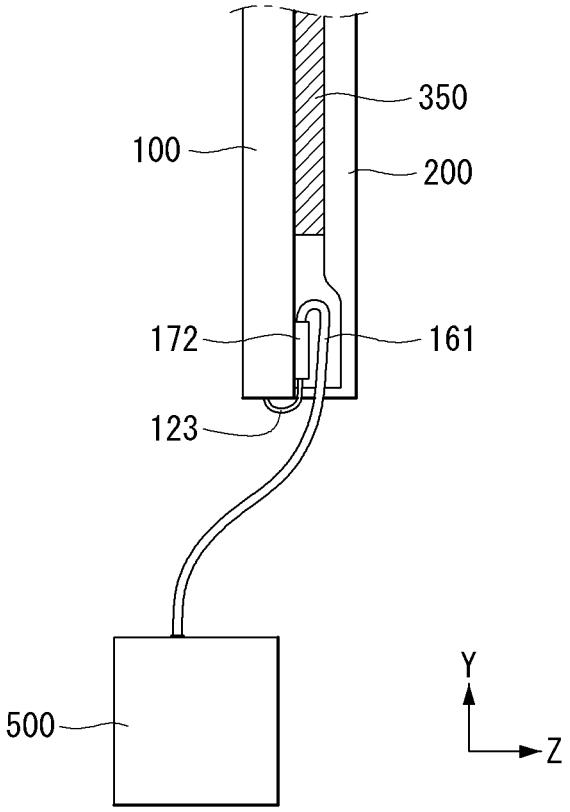

Referring to FIGS. 6A to 6C, the display device according to the embodiment may require a formation space of the source PCB 172 in the body 10. For example, as shown in FIG. 6A, a portion of the back cover 200 corresponding to the source PCB 172 may be inwardly depressed. The portion of the back cover 200 corresponding to the source PCB 172 may be thinner than another portion of the back cover 200. Because a thickness of the back cover 200 is not uniform, rigidity of the back cover 200 may be improved. Because the portion of the back cover 200 corresponding to the source PCB 172 is thinner than the other portion of the back cover 200, the source PCB 172 may be positioned on the back surface of the display panel 100 irrespective of a thickness of the adhesive sheet 350.

As shown in FIG. 6B, a portion of the back cover 200 corresponding to the source PCB 172 may have a same thickness as the other portion of the back cover 200. No portion of the back cover 200 may be depressed. In this instance, a thickness of the adhesive sheet 350 between the display panel 100 and the back cover 200 in the third direction may be greater than a thickness of the source PCB 172 in the third direction. Because the portion of the back cover 200 corresponding to the source PCB 172 has the same thickness as other portion of the back cover 200, a manufacturing process of the back cover 200 may be simplified, and manufacturing costs of the display device may be reduced.

As shown in FIG. 6C, the source PCB 172 may transmit an electrical signal to the housing 500 though a FFC 161. One side of the source PCB 172 may be connected to a source COF 123, and another side may be connected to the FFC 161. The FFC 161 may include a plurality of signal connection terminal pins and at least one ground terminal pin for connecting the housing 500 to the source PCB 172. The FFC 161 may be cheaper than other cables.

The display device according to the embodiment may position the source PCB 172 between the display panel 100 and the back cover 200. Thus, the back cover 200 may not require a hole or a cavity, a crack may not form in the back cover 200, and the rigidity of the back cover 200 may be improved. In the following embodiments, description of structures related to the source PCB 172 may be briefly made or may be omitted for the sake of brevity and ease of reading. The structures related to the source PCB 172 may be applied to other embodiments.

Figure 7A:
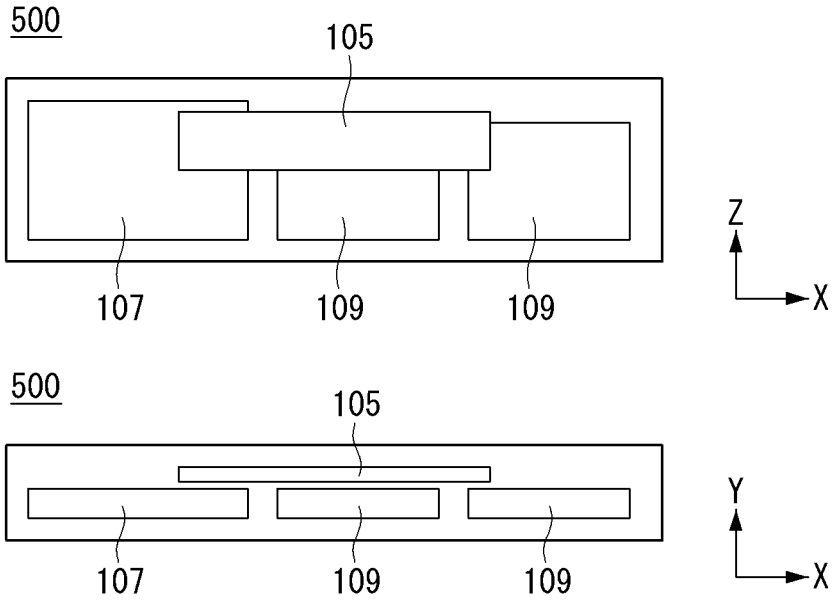
Figure 7B:
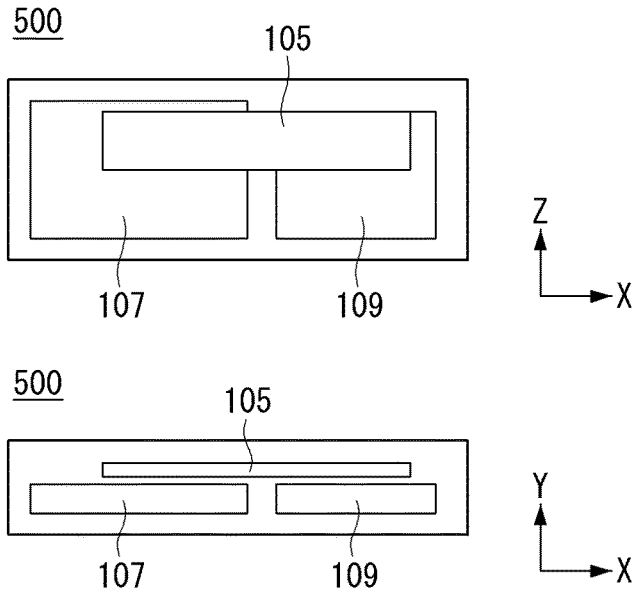

Referring to FIGS. 7A and 7B, at least one PCB may be positioned inside the housing 500. The PCBs may be separated from each other. For example, at least one PCB may be a main board 109. The main board 109 may provide an interface for operating the display device. Further, the main board 109 may check and control an operation state of the components of the display device, and thus, may maintain the components of the display device in an optimum state.

At least one PCB may be a power supply board 107. The power supply board 107 may supply electric power to the display device. The power supply board 107 may supply electric power to the body. The power supply board 107 may convert an AC frequency into a DC frequency. The power supply board 107 may convert a low frequency into a high frequency and may improve the electrical efficiency.

At least one PCB may be a timing controller board 105. The timing controller board 105 may transmit an input signal to the display panel 100. The timing controller board 105 may transmit timing signals CLK, LOAD, and SPi for controlling the source PCB and video signals R, G, and B to the source PCB. Further, the timing controller board 105 may control an image. The timing controller board 105 may be connected to the source PCB through one of the FFC, the circular cable, and the wireless communication.

As shown in FIG. 7A, the main boards 109 may be positioned respectively in a middle of the housing 500 and on a right side of the housing 500 and may be separated from each other. The power supply board 107 may be positioned opposite the main board 109 positioned on the right side of the housing 500 in a direction, for example, a long axis direction, of the housing 500 with respect to the middle of the housing 500.

The timing controller board 105 may be positioned on upper surfaces of the main boards 109 and the power supply board 107. Because the timing controller board 105 is positioned on the upper surfaces of the main boards 109 and the power supply board 107, an internal space of the housing 500 may be saved. A timing controller shield may be attached to a location where the timing controller board 105 may be mounted so as to block electromagnetic waves emitted from the power supply board 107 and the main boards 109. The timing controller board 105 may be connected to not the power supply board 107 and the main boards 109 but the timing controller shield. Thus, the timing controller board 105, the power supply board 107, and the main boards 109 may not interfere with one another, and the timing controller shield may protect the timing controller board 105 from impact.

The timing controller board 105 may overlap the power supply board 107 and the main boards 109 in a height direction of the housing 500. Thus, the timing controller board 105 may be more easily connected to the power supply board 107 and the main boards 109. As shown in FIG. 7B, one main board 109 may be mounted inside the housing 500. The main board 109 may be positioned on one side of the housing 500, and the power supply board 107 may be positioned opposite the main board 109 in the long axis direction of the housing 500. Because the display device according to the embodiment positions the timing controller board 105 on the power supply board 107 and the main board 109, a space of the housing 500 may be saved. Thus, the user may feel that the appearance of the display device may be improved because of a reduction in the size of the housing 500.

Figure 8A:
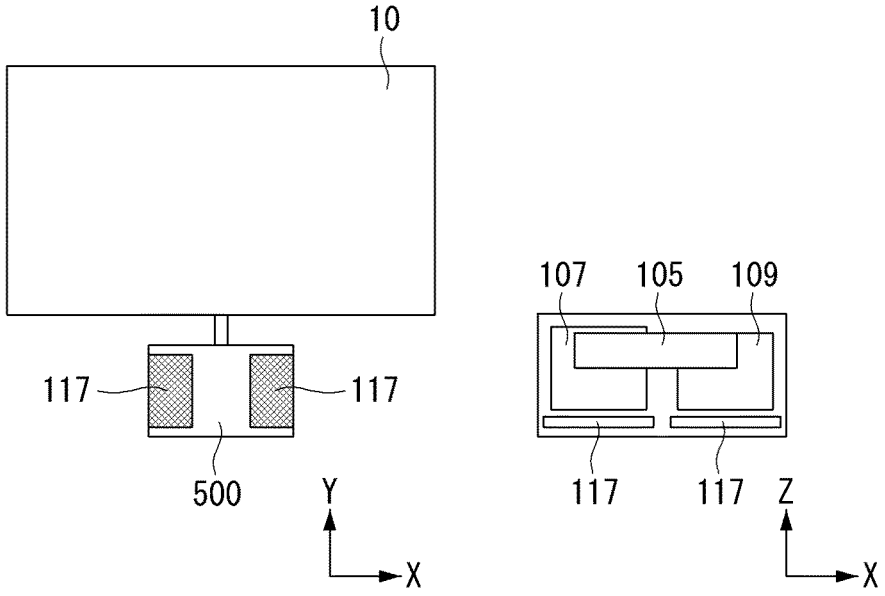
Figure 8B:
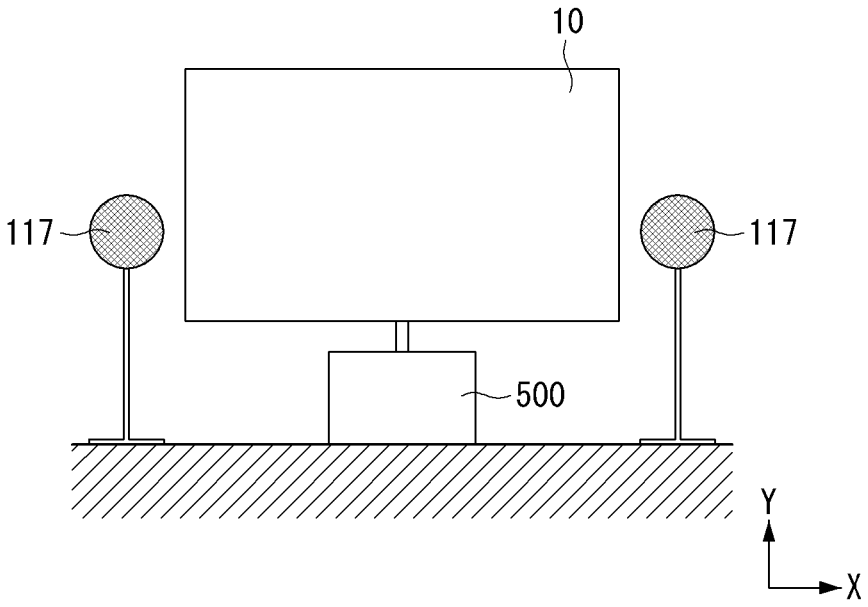

Referring to FIGS. 8A and 8B, the display device according to the embodiment may position speakers 117 on both sides of a front surface of the housing 500, respectively. The speaker 117 may output and transmit sound to the user. Thus, it may be more efficient to have the speakers 117 positioned on the front surface of the housing 500.

As shown in FIG. 8A, the speakers 117 may be separated from at least one PCB mounted inside the housing 500 and may be mounted on the front surface of the housing 500. Alternatively, as shown in FIG. 8B, the speakers 117 may be positioned to be separated from each other outside the housing 500. Because the speakers 117 are positioned outside the housing 500, the user may place or move the speakers 117 to a location where the sound may be satisfactorily transmitted to the user. The speakers 117 may be positioned on both sides of the body 10 of the display device. The display device according to the embodiment may provide the speakers 117 on the front surface of the housing 500 or both sides outside the housing 500. Thus, the user may more satisfactorily receive the sound from the display device.

In the following description, the speaker 117 may mean a speaker assembly 400, or the speaker assembly 400 may be regarded as including the speaker 117. Both the speaker 117 and the speaker assembly 400 may be regarded as providing the sound.

Figure 9:
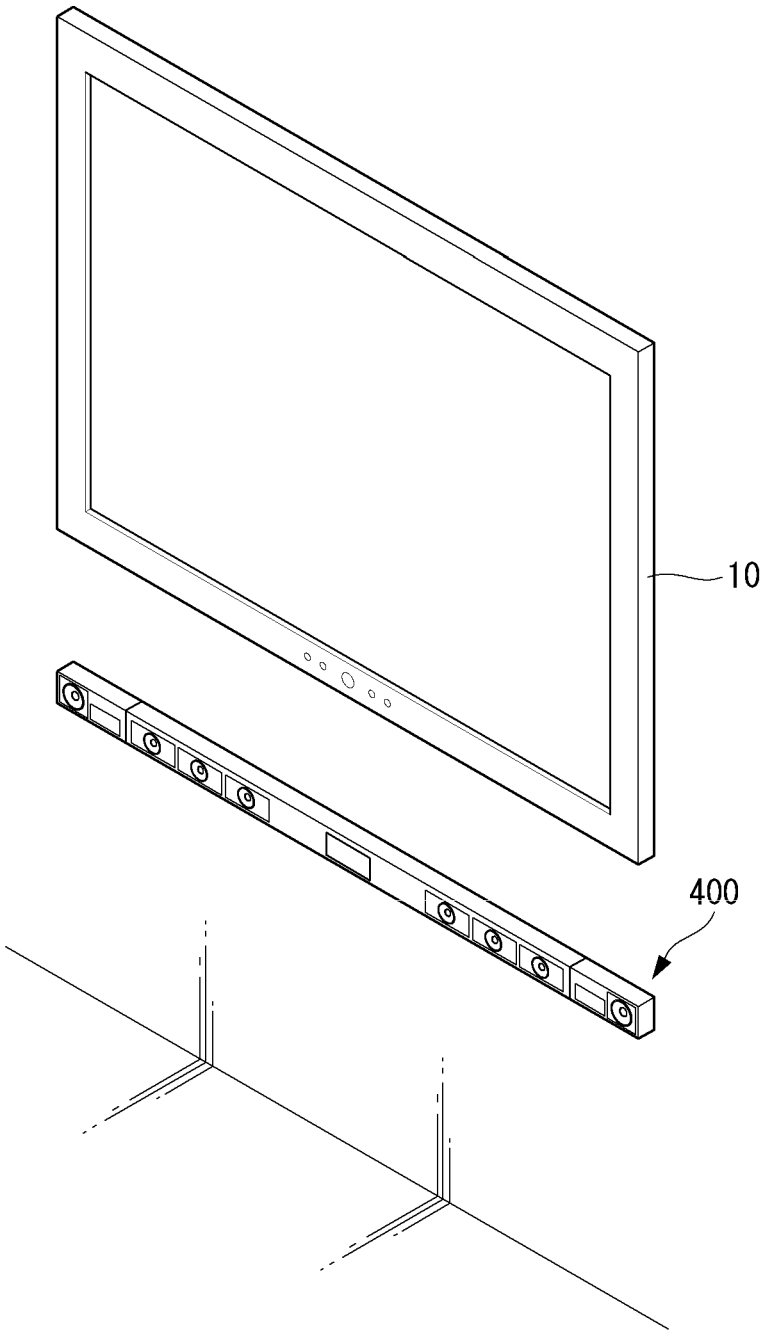
FIG. 9 is a view of a display device and a speaker assembly according to an embodiment.
Figure 10A:
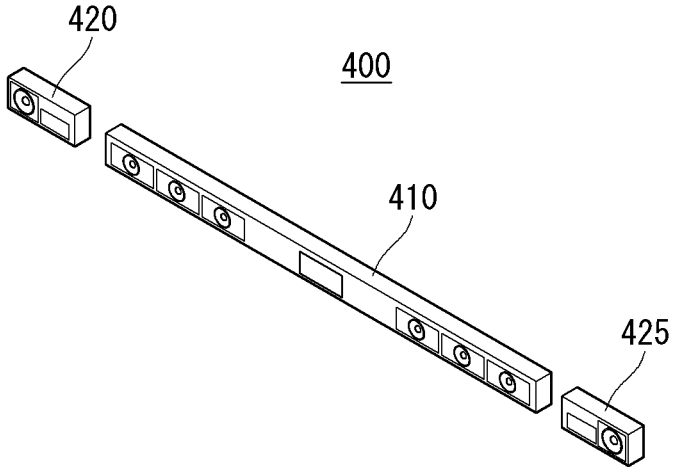
FIG. 10A to FIG. 10C are views of a speaker assembly according to an embodiment.
Figure 10B:
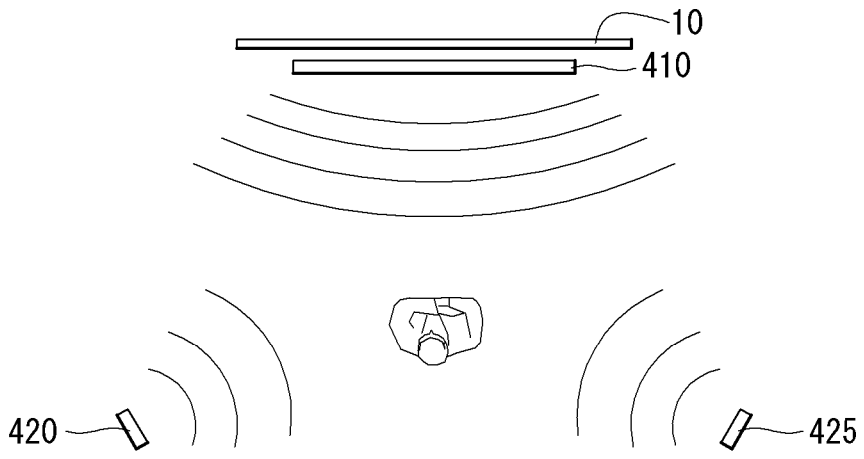
Figure 10C:
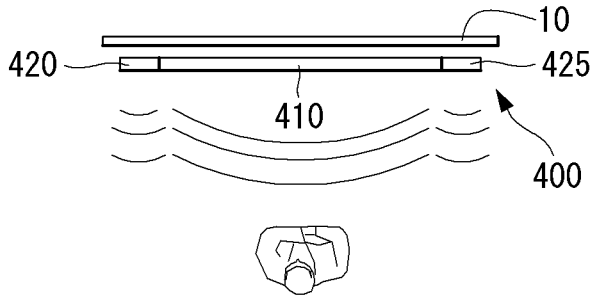

FIG. 9 is a view of a display device and a speaker assembly according to the embodiment. FIGS. 10A-10C are views of a speaker assembly according to the embodiment. Referring to FIGS. 9 and 10A, the speaker assembly 400 may be separated from the display device 10. The speaker assembly 400 may be connected to the display device 10 wirelessly manner or with wires. The display device 10 may include a separate speaker or may not include a speaker.

The speaker assembly 400 may include a speaker unit or speaker. The speaker assembly 400 may include a plurality of speaker units or speakers. For example, the speaker assembly 400 may include a first speaker unit providing a high frequency sound, a second speaker unit providing a medium frequency sound, and a third speaker unit providing a low frequency sound. The speaker assembly 400 may include a first speaker unit providing a high frequency sound and a second speaker unit providing a low frequency sound. The speaker assembly 400 may include three speaker units. A first speaker unit 410 may provide a high frequency sound and a low frequency sound. A second speaker unit 420 or a third speaker unit 425 may provide a low frequency sound. The second speaker unit 420 or the third speaker unit 425 may be used to improve a performance of the first speaker unit 410.

Referring to FIG. 10B, the second speaker unit 420 or the third speaker unit 425 may be positioned to be separated from the first speaker unit 410 by a predetermined distance to provide the sound. This is to provide a more improved sound to the user watching the display device 10. Thus, the speaker assembly 400 may provide a surround sound for the user.

Referring to FIG. 10C, the second speaker unit 420 or the third speaker unit 425 may be coupled with the first speaker unit 410 to provide the sound. This is to provide a more extended and improved sound to the user watching the display device 10. The speaker assembly 400 may further enhance the low frequency sound and then provide the enhanced low frequency sound to the user. Alternatively, the speaker assembly 400 may further enhance the medium/low frequency sound and then provide the enhanced medium/low frequency sound to the user.

Figure 11:
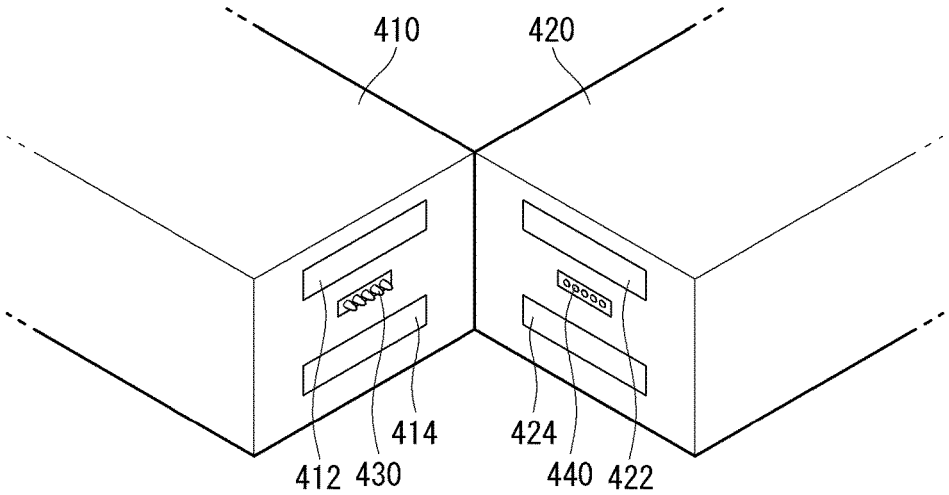
FIG. 11 to FIG. 17 are views of coupling components of a speaker assembly according to an embodiment.

FIGS. 11 to 17 are views of coupling components of the speaker assembly according to the embodiment of the disclosure. Referring to FIG. 11, the first speaker unit 410 may be coupled with the second speaker unit 420 or may be separated from the second speaker unit 420. The first speaker unit 410 may include first magnetic bodies or magnets 412 and 414, and the second speaker unit 420 may include second magnetic bodies or magnets 422 and 424. The first magnetic bodies 412 and 414 may have a magnetic polarity different from the second magnetic bodies 422 and 424. For example, when the first magnetic bodies 412 and 414 have a magnetic polarity of N-pole, the second magnetic bodies 422 and 424 may have a magnetic polarity of S-pole. When the first magnetic bodies 412 and 414 have a magnetic polarity of S-pole, the second magnetic bodies 422 and 424 may have a magnetic polarity of N-pole. The first magnetic bodies 412 and 414 and/or the second magnetic bodies 422 and 424 may be a plurality of magnetic bodies. The plurality of first magnetic bodies 412 and 414 may have a magnetic polarity different from the plurality of second magnetic bodies 422 and 424.

The first magnetic bodies 412 and 414 may be positioned on a side of the first speaker unit 410. The first magnetic bodies 412 and 414 may be positioned inside the side of the first speaker unit 410. The first magnetic bodies 412 and 414 may be positioned outside the side of the first speaker unit 410. The first speaker unit 410 may include a first connector 430. The first connector 430 may be positioned on the side of the first speaker unit 410. For example, the first connector 430 may be a pogo pin. The plurality of first magnetic bodies 412 and 414 may be symmetric to each other with respect to the first connector 430. One of the plurality of first magnetic bodies 412 and 414, for example, 412, may be positioned on one side of the first connector 430, and another first magnetic body, for example, 414, may be positioned on another side of the first connector 430. The plurality of first magnetic bodies 412 and 414 may be positioned on the upper and lower sides or the left and right sides of the first connector 430.

The second magnetic bodies 422 and 424 may be positioned on the side of the second speaker unit 420. The second magnetic bodies 422 and 424 may be positioned inside the side of the second speaker unit 420. The second magnetic bodies 422 and 424 may be positioned outside the side of the second speaker unit 420. The second speaker unit 420 may include a second connector 440. The second connector 440 may be positioned on the side of the second speaker unit 420. For example, the second connector 440 may be a pogo pin. The plurality of second magnetic bodies 422 and 424 may be symmetric to each other with respect to the second connector 440. One of the plurality of second magnetic bodies 422 and 424, for example, 422, may be positioned on one side of the second connector 440, and another second magnetic body, for example, 424, may be positioned on another side of the second connector 440. The plurality of second magnetic bodies 422 and 424 may be positioned on upper and lower sides or left and right sides of the second connector 440. The second connector 440 may be inserted into the first connector 430. The first connector 430 may be inserted into the second connector 440. The first connector 430 and the second connector 440 may be electrically connected to each other. For example, the first connector 430 may be a male pogo pin, and the second connector 440 may be a female pogo pin. Thus, the first connector 430 and the second connector 440 may be solidly connected to each other.

Figure 12:
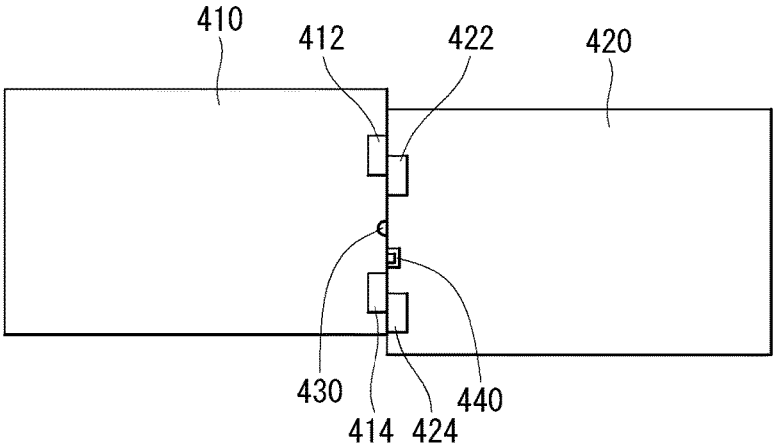

Referring to FIG. 12, the first speaker unit 410 may be coupled with the second speaker unit 420. In this instance, a coupling of the first speaker unit 410 and the second speaker unit 420 may be performed through a coupling of the first magnetic bodies 412 and 414 and the second magnetic bodies 422 and 424. When one side of the first speaker unit 410 is adjacent to one side of the second speaker unit 420, the first speaker unit 410 and the second speaker unit 420 may be coupled with each other by magnetic force. The first magnetic bodies 412 and 414 and the second magnetic bodies 422 and 424 may contribute to the coupling of the first speaker unit 410 and the second speaker unit 420. However, it may be difficult for the first magnetic bodies 412 and 414 and the second magnetic bodies 422 and 424 to contribute to inserting the first connector 430 into the second connector 440. Thus, the first speaker unit 410 and the second speaker unit 420 may be misaligned.

Figure 13:
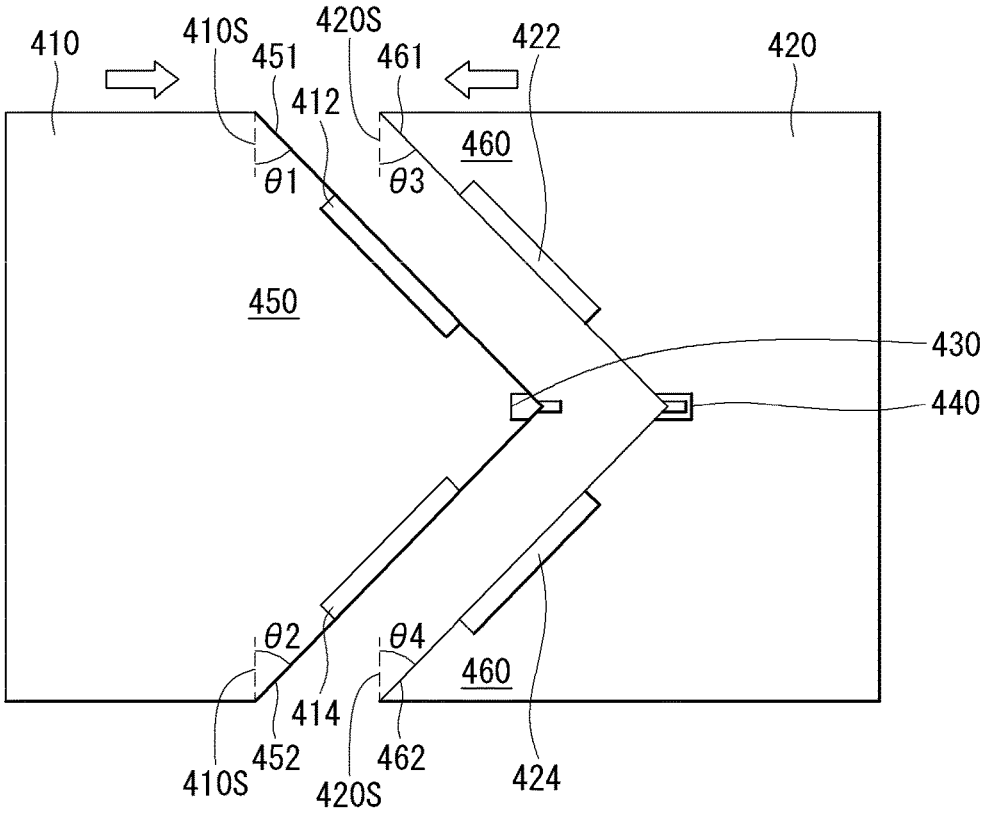

Referring to FIG. 13, the first speaker unit 410 may include a first connecting portion 450. The first connecting portion 450 may be formed on a side or a side surface of the first speaker unit 410. The first connecting portion 450 may protrude from the side or the side surface of the first speaker unit 410. The first connecting portion 450 may include a protrusion protruding out from the first speaker unit 410. The first connecting portion 450 may have a plurality of surfaces.

The first connecting portion 450 may have a first surface 451 and a second surface 452. The first surface 451 and the second surface 452 may meet each other. The first surface 451 and the second surface 452 may meet each other at one side. The first surface 451 and the second surface 452 may form a side or corner while meeting each other. Thus, the first connecting portion 450 may have a triangular shape or a triangular pyramid shape. The first connecting portion 450 may have the triangular shape with respect to a cross section of the first speaker unit 410. The protrusion of the first connecting portion 450 may have the first surface 451 and the second surface 452.

The first surface 451 may be inclined at a predetermined angle θ1. For example, the first surface 451 may be inclined from one side surface 410S of the first speaker unit 410 at the angle θ1 of about 30° to 60°. The first surface 451 may be inclined from the side surface 410S of the first speaker unit 410 at the angle θ1 of about 45°. The second surface 452 may be inclined at a predetermined angle θ2. For example, the second surface 452 may be inclined from one side surface 410S of the first speaker unit 410 at the angle θ2 of about 30° to 60°. The second surface 452 may be inclined from the side surface 410S of the first speaker unit 410 at the angle θ2 of about 45°.

As another example, the first connecting portion 450 may have the triangular pyramid shape or a poly-pyramid shape with respect to the side of the first speaker unit 410. In other words, the first connecting portion 450 may have a pyramid shape with respect to the side of the first speaker unit 410. The first connecting portion 450 may form a dome with respect to the side of the first speaker unit 410.

The first connector 430 may be positioned between the first surface 451 and the second surface 452. The first connector 430 may be positioned on the side formed by the first surface 451 and the second surface 452. The first connector 430 may be positioned at a tip of the first connecting portion 450. The first connector 430 may be positioned inside the first speaker unit 410. An end of the first connector 430 may be exposed to an outside of the first speaker unit 410 or an outside of the first connecting portion 450. In this instance, the end of the first connector 430 may be protruded and exposed to the outside of the first speaker unit 410 or the outside of the first connecting portion 450. For example, when the first connector 430 is the pogo pin, the pogo pin may protrude out from the first speaker unit 410 or from the first connecting portion 450.

The second speaker unit 420 may include a second connecting portion 460. The second connecting portion 460 may be formed on a side or a side surface of the second speaker unit 420. The second connecting portion 460 may be inwardly depressed at the side or the side surface of the second speaker unit 420. The second connecting portion 460 may include a depression or recess depressed inward in the second speaker unit 420. The second connecting portion 460 may have a plurality of surfaces.

The second connecting portion 460 may have a first surface 461 and a second surface 462. The first surface 461 and the second surface 462 may meet each other. The first surface 461 and the second surface 462 may meet each other at one side. The first surface 461 and the second surface 462 may form one side while meeting each other. Thus, the second connecting portion 460 may entirely have a triangular shape or an intaglio triangular pyramid shape. The second connecting portion 460 may have the triangular shape with respect to a cross section of the second speaker unit 420. The depression of the second connecting portion 460 may have the first surface 461 and the second surface 462.

The first surface 461 may be inclined at a predetermined angle θ3. For example, the first surface 461 may be inclined from one side surface 420S of the second speaker unit 420 at the angle θ3 of about 30° to 60°. The first surface 461 may be inclined from the side surface 420S of the second speaker unit 420 at the angle θ3 of about 45°. The second surface 462 may be inclined at a predetermined angle θ4. For example, the second surface 462 may be inclined from one side surface 420S of the second speaker unit 420 at the angle θ4 of about 30° to 60°. The second surface 462 may be inclined from the side surface 420S of the second speaker unit 420 at the angle θ4 of about 45°.

As another example, the second connecting portion 460 may have the intaglio triangular pyramid shape or an intaglio poly-pyramid shape with respect to the side of the second speaker unit 420. In other words, the second connecting portion 460 may have an intaglio pyramid shape with respect to the side of the second speaker unit 420. The second connecting portion 460 may form a bowl shape with respect to the side of the second speaker unit 420.

The second connector 440 may be positioned between the first surface 461 and the second surface 462. The second connector 440 may be positioned on the side formed by the first surface 461 and the second surface 462. The second connector 440 may be positioned at a tip of the bottom of the second connecting portion 460. The second connector 440 may be positioned inside the second speaker unit 420 or the second connecting portion 460. An end of the second connector 440 may be exposed to an outside of the second speaker unit 420 or an outside of the second connecting portion 460. In this instance, the one end of the second connector 440 may be protruded and exposed to the outside of the second speaker unit 420 or the outside of the second connecting portion 460. For example, when the first connector 430 and the second connector 440 are the pogo pin, a terminal of the second connector 440, into which the pin of the first connector 430 may be inserted, may be exposed to the outside of the second speaker unit 420 or the outside of the second connecting portion 460.

The first magnetic bodies 412 and 414 may be positioned at the first connecting portion 450. The first magnetic bodies 412 and 414 may be a plurality of magnetic bodies. One of the plurality of first magnetic bodies 412 and 414, for example, 412, may be positioned on the first surface 451, and the other first magnetic body, for example, 414, may be positioned on the second surface 452. The first magnetic bodies 412 and 414 may be positioned inside or outside of the first connecting portion 450. The second magnetic bodies 422 and 424 may be positioned at the second connecting portion 460. The second magnetic bodies 422 and 424 may be in plural. One of the plurality of second magnetic bodies 422 and 424, for example, 422, may be positioned on the first surface 461, and other second magnetic body, for example, 424, may be positioned on the second surface 462. The second magnetic bodies 422 and 424 may be positioned inside or outside of the second connecting portion 460.

Figure 14:
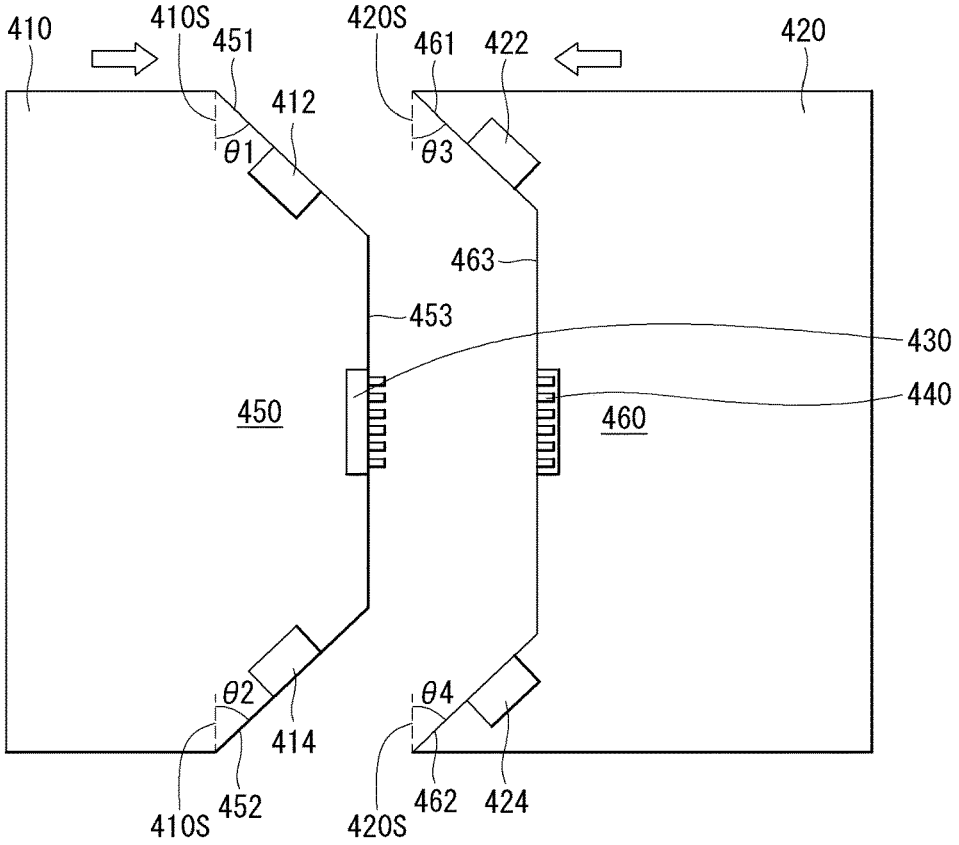

Referring to FIG. 14, the first connecting portion 450 may have a first surface 451, a second surface 452, and a third surface 453. The first connecting portion 450 may protrude from the side of the first speaker unit 410. The first surface 451 may be inclined at a predetermined angle θ1. For example, the first surface 451 may be inclined from one side surface 410S of the first speaker unit 410 at the angle θ1 of about 30° to 60° The first surface 451 may be inclined from the side surface 410S of the first speaker unit 410 at the angle θ1 of about 45°. The second surface 452 may be inclined at a predetermined angle θ2. For example, the second surface 452 may be inclined from one side surface 410S of the first speaker unit 410 at the angle θ2 of about 30° to 60°. The second surface 452 may be inclined from the side surface 410S of the first speaker unit 410 at the angle θ2 of about 45°.

The third surface 453 may connect the first surface 451 and the second surface 452. The third surface 453 may meet the first surface 451. The third surface 453 and the first surface 451 may form one side while meeting each other. The third surface 453 may extend from the first surface 451 to the second surface 452. The third surface 453 may meet the second surface 452. The third surface 453 and the second surface 452 may form one side while meeting each other. The third surface 453 may or may not be parallel to a side surface of the first speaker unit 410. The third surface 453 may be entirely or somewhat parallel to the side surface of the first speaker unit 410. The third surface 453 may form a trapezoid cross-section along with the first and second surfaces 451 and 452. The first, second, and third surfaces 451, 452, and 453 may form a poly-pyramid shape, in which a tip may be removed, with respect to the side of the first speaker unit 410. A protrusion of the first connecting portion 450 may include the first surface 451, the second surface 452, and the third surface 453.

The first connector 430 may be positioned on the third surface 453. The first connector 430 may be positioned inside the first speaker unit 410 or the first connecting portion 450. An end of the first connector 430 may be exposed to an outside of the first speaker unit 410 or an outside of the first connecting portion 450. The end of the first connector 430 may be protruded and exposed to the outside of the first speaker unit 410 or the outside of the first connecting portion 450. For example, when the first connector 430 is the pogo pin, the pogo pin may protrude out from the first speaker unit 410 or from the first connecting portion 450.

The second connecting portion 460 may have a first surface 461, a second surface 462, and a third surface 463. The first surface 461 may be inclined at a predetermined angle θ3. For example, the first surface 461 may be inclined from one side surface 420S of the second speaker unit 420 at the angle θ3 of about 30° to 60°. The first surface 461 may be inclined from the side surface 420S of the second speaker unit 420 at the angle θ3 of about 45°. The second surface 462 may be inclined at a predetermined angle θ4. For example, the second surface 462 may be inclined from one side surface 420S of the second speaker unit 420 at the angle θ4 of about 30° to 60°. The second surface 462 may be inclined from the side surface 420S of the second speaker unit 420 at the angle θ4 of about 45°.

The third surface 463 may connect the first surface 461 and the second surface 462. The third surface 463 may meet the first surface 461. The third surface 463 and the first surface 461 may form one side while meeting each other. The third surface 463 may extend from the first surface 461 to the second surface 462. The third surface 463 may meet the second surface 462. The third surface 463 and the second surface 462 may form one side while meeting each other. The third surface 463 may or may not be parallel to one side surface 420*s* of the second speaker unit 420. The third surface 463 may be entirely or somewhat parallel to one side surface 420*s* of the second speaker unit 420. The third surface 463 may form a trapezoid cross-section along with the first and second surfaces 461 and 462. The first, second, and third surfaces 461, 462, and 463 may form an angular bowl shape with respect to the side of the second speaker unit 420. The third surface 463 of the second connecting portion 460 may be opposite to the third surface 453 of the first connecting portion 450. A depression or recess of the second connecting portion 460 may include the first surface 461, the second surface 462, and the third surface 463.

The second connector 440 may be positioned on the third surface 463. The second connector 440 may be positioned inside the second speaker unit 420 or the second connecting portion 460. An end of the second connector 440 may be exposed to the outside of the second speaker unit 420 or the outside of the second connecting portion 460. The end of the second connector 440 may be protruded and exposed to the outside of the second speaker unit 420 or the outside of the second connecting portion 460. For example, when the first connector 430 and the second connector 440 are the pogo pin, a terminal of the second connector 440, into which the pin of the first connector 430 may be inserted, may be exposed to the outside of the second speaker unit 420 or the outside of the second connecting portion 460.

Figure 15:
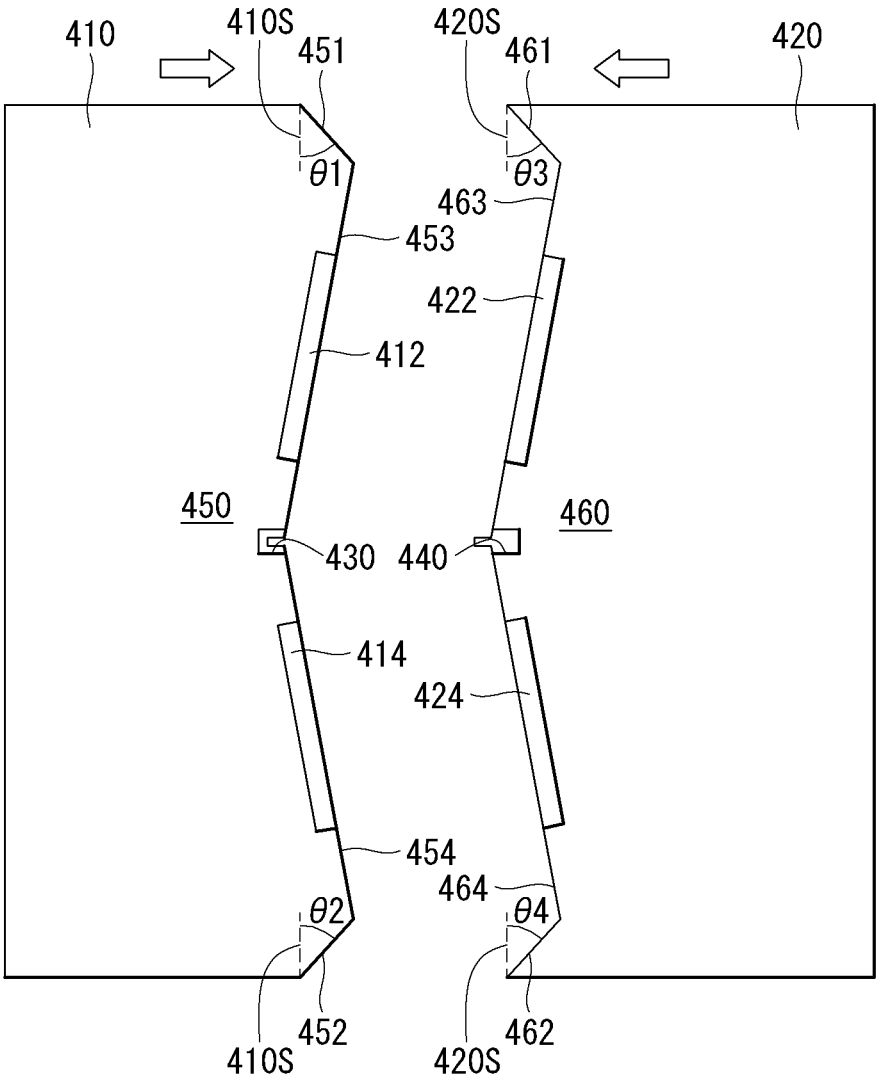

Referring to FIG. 15, the first connecting portion 450 may have a first surface 451, a second surface 452, a third surface 453, and a fourth surface 454. As the first surface 451 and the second surface 452 have been described above, further description may be briefly made or may be omitted. The third surface 453 may extend from the first surface 451. The third surface 453 may meet the first surface 451. The third surface 453 and the first surface 451 may form one side while meeting each other. The third surface 453 may be inclined at an angle different from the first surface 451. The first surface 451 may be inclined toward the outside of the first connecting portion 450, and the third surface 453 may be inclined toward the inside of the first connecting portion 450. The inclination of the third surface 453 may be gentler than the inclination of the first surface 451. The first surface 451 and the third surface 453 may form a protruding shape.

The fourth surface 454 may extend from the second surface 452. The fourth surface 454 may meet the second surface 452. The fourth surface 454 and the second surface 452 may form one side while meeting each other. The fourth surface 454 may be inclined at an angle different from the second surface 452. The second surface 452 may be inclined toward the outside of the first connecting portion 450, and the fourth surface 454 is inclined toward the inside of the first connecting portion 450. The inclination of the fourth surface 454 may be gentler than the inclination of the second surface 452. The second surface 452 and the fourth surface 454 may form a protruding shape. The third surface 453 and the fourth surface 454 may meet each other. The third surface 453 and the fourth surface 454 may form one side while meeting each other. The third surface 453 and the fourth surface 454 may form a depressed shape. For example, the third surface 453 and the fourth surface 454 may form a plate or funnel shape.

The first connector 430 may be positioned on the side formed by the third surface 453 and the fourth surface 454. The first connector 430 may be positioned inside the first speaker unit 410 or the first connecting portion 450. The first connector 430 may be protruded and exposed from the inside of the first speaker unit 410 or the first connecting portion 450 to the outside. For example, when the first connector 430 is the pogo pin, the first connector 430 may have a terminal, into which the pogo pin may be inserted. The terminal of the first connector 430 may be protruded and exposed to the outside of the first speaker unit 410 or the first connecting portion 450.

The second connecting portion 460 may have a first surface 461, a second surface 462, a third surface 463, and a fourth surface 464. The third surface 463 may extend from the first surface 461. The third surface 463 may meet the first surface 461. The third surface 463 and the first surface 461 may form one side while meeting each other. The third surface 463 may be inclined at an angle different from the first surface 461. The first surface 461 may be inclined toward the inside of the second connecting portion 460, and the third surface 463 may be inclined toward the outside of the second connecting portion 460. The inclination of the third surface 463 may be gentler than the inclination of the first surface 461.

The fourth surface 464 may extend from the second surface 462. The fourth surface 464 may meet the second surface 462. The fourth surface 464 and the second surface 462 may form one side while meeting each other. The fourth surface 464 may be inclined at an angle different from the second surface 462. The second surface 462 may be inclined toward the inside of the second connecting portion 460, and the fourth surface 464 may be inclined toward the outside of the second connecting portion 460. The inclination of the fourth surface 464 may be gentler than the inclination of the second surface 462. The third surface 463 and the fourth surface 464 may meet each other. The third surface 463 and the fourth surface 464 may form one side while meeting each other. The third surface 463 and the fourth surface 464 may form a protruding shape. For example, the third surface 463 and the fourth surface 464 may form a dome shape.

In the first connecting portion 450, a protrusion may include the first surface 451 and the third surface 453. Further, another protrusion may include the second surface 452 and the fourth surface 454. In the first connecting portion 450, a depression or recess may include the third surface 453 and the fourth surface 454. In the second connecting portion 460, a protrusion may include the third surface 463 and the fourth surface 464. A depression or recess may include the first surface 461 and the third surface 463. Further, another depression or recess may include the second surface 462 and the fourth surface 464.

The second connector 440 may be positioned on the side formed by the third surface 463 and the fourth surface 464. The second connector 440 may be positioned inside the second speaker unit 420 or the second connecting portion 460. The second connector 440 may be protruded or exposed from the inside of the second speaker unit 420 or the second connecting portion 460 to the outside. For example, when the second connector 440 is the pogo pin, the pogo pin of the second connector 440 may be protruded or exposed to the outside of the second speaker unit 420 or the second connecting portion 460.

The first connecting portion 450 may entirely have a shape that corresponds to the second connecting portion 460. Alternatively, the second connecting portion 460 may entirely have a shape that corresponds to the first connecting portion 450. The first to fourth surfaces 451 to 454 of the first connecting portion 450 may respectively face the first to fourth surfaces 461 to 464 of the second connecting portion 460. Thus, the first connecting portion 450 may be easily coupled with the second connecting portion 460. The first speaker unit 410 may be easily coupled with the second speaker unit 420. The first speaker unit 410 may be coupled with or sunken into the second speaker unit 420. In other words, the first speaker unit 410 and the second speaker unit 420 may be coupled with each other at a particular location.

As another example, the first connector 430 may be properly inserted into the second connector 440. When the first speaker unit 410 is coupled with the second speaker unit 420, the first connector 430 may be inserted into the second connector 440. For example, when the second speaker unit 420 is positioned close to the first speaker unit 410, the second speaker unit 420 may be coupled with the first speaker unit 410 due to shapes of the first connecting portion 450 and the second connecting portion 460 and the magnetic forces of the first magnetic bodies 412 and 414 and the second magnetic bodies 422 and 424, without extra effort from the user.

Figure 16:
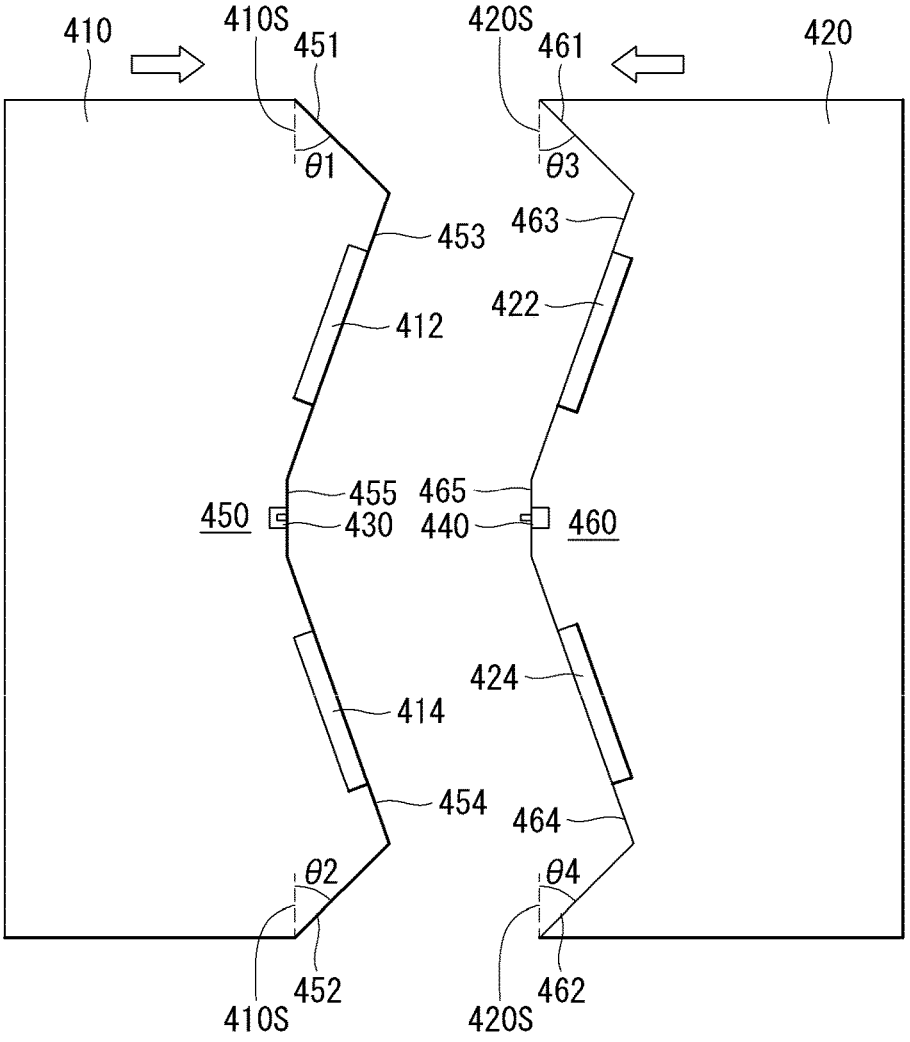

Referring to FIG. 16, the first connecting portion 450 may have a first surface 451, a second surface 452, a third surface 453, a fourth surface 454, and a fifth surface 455. As the first to fourth surfaces 451 to 454 have been described above, a further description may be briefly made or may be omitted. The fifth surface 455 may extend from the third surface 453 or the fourth surface 454. The fifth surface 455 may be positioned between the third surface 453 and the fourth surface 454. The fifth surface 455 may meet the third surface 453 at one side. The fifth surface 455 may meet the fourth surface 454 at one side. The fifth surface 455 may extend from the third surface 453 to the fourth surface 454. The fifth surface 455 may or may not be parallel to one side surface of the first speaker unit 410. The fifth surface 455 may be entirely or somewhat parallel to one side surface of the first speaker unit 410. Cross sections of the first to fifth surfaces 451 to 455 may form two left and right protrusions and a center depression or recess. As another example, the first to fifth surfaces 451 to 455 may form a crater with respect to the side of the first speaker unit 410. The first connector 430 may be positioned on the fifth surface 455. The fifth surface 455 may provide a formation location of the first connector 430 facing the second connector 440.

The second connecting portion 460 may have a first surface 461, a second surface 462, a third surface 463, a fourth surface 464, and a fifth surface 465. As the first to fourth surfaces 461 to 464 have been described above, a further description may be briefly made or may be omitted. The fifth surface 465 may extend from the third surface 463 or the fourth surface 464. The fifth surface 465 may be positioned between the third surface 463 and the fourth surface 464. The fifth surface 465 may meet the third surface 463 at one side. The fifth surface 465 may meet the fourth surface 464 at one side. The fifth surface 465 may extend from the third surface 463 to the fourth surface 464. The fifth surface 465 may or may not be parallel to one side surface of the second speaker unit 420. The fifth surface 465 may be entirely or somewhat parallel to one side surface of the second speaker unit 420. Cross sections of the first to fifth surfaces 461 to 465 may form two left and right depressions and a center protrusion.

In the first connecting portion 450, the protrusion may include the first surface 451 and the third surface 453. The protrusion may include the second surface 452 and the fourth surface 454. The depression may include the third surface 453, the fourth surface 454, and the fifth surface 455. In the second connecting portion 460, the protrusion may include the third surface 463, the fourth surface 464, and the fifth surface 465. The depression may include the first surface 461 and the third surface 463. The depression may include the second surface 462 and the fourth surface 464. As another example, the first to fifth surfaces 461 to 465 may entirely form an uplifted shape with respect to the side of the second speaker unit 420. The first connector 440 may be positioned on the fifth surface 465. The fifth surface 465 may provide a formation location of the second connector 440 facing the first connector 430.

When the first speaker unit 410 is coupled with the second speaker unit 420, the first connector 430 may be electrically connected to the second connector 440. In this instance, the second connector 440 may be inserted into the first connector 430. For example, when the first connector 430 and the second connector 440 are the pogo pins, a protruding pin of the second connector 440 may be inserted into a terminal included in the first connector 430. In FIG. 16, the protruding pin of the second connector 440 may be inserted into the first connector 430 based on the shapes of the first connecting portion 450 and the second connecting portion 460 without damaging the protruding pin.

The first connecting portion 450 may have a shape that corresponds completely to the second connecting portion 460. The first to fifth surfaces 451 to 455 of the first connecting portion 450 may respectively face the first to fifth surfaces 461 to 465 of the second connecting portion 460. Thus, the first connecting portion 450 may be easily coupled with the second connecting portion 460. The first speaker unit 410 may be easily coupled with the second speaker unit 420. The first speaker unit 410 may be coupled with or sunken into the second speaker unit 420. In other words, the first speaker unit 410 and the second speaker unit 420 may be coupled with each other at a particular location.

As another example, the second connector 440 may be properly inserted into the first connector 430. When the first speaker unit 410 is coupled with the second speaker unit 420, the second connector 440 may be inserted into the first connector 430. For example, when the second speaker unit 420 is positioned close to the first speaker unit 410, the second speaker unit 420 may be properly and accurately coupled with the first speaker unit 410 due to the shapes of the first connecting portion 450 and the second connecting portion 460 and the magnetic forces of the first magnetic bodies 412 and 414 and the second magnetic bodies 422 and 424, without extra effort from the user.

Figure 17:
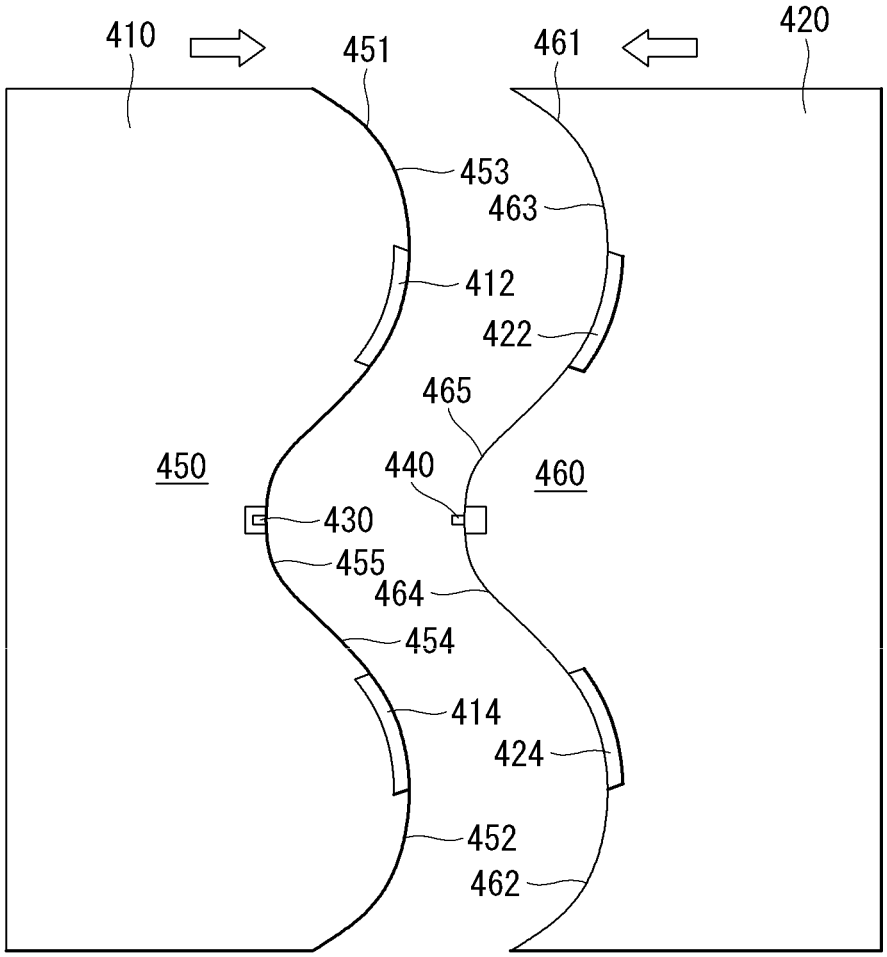

Referring to FIG. 17, first to fifth surfaces 451 to 455 of the first connecting portion 450 may form a curved line. First to fifth surfaces 461 to 465 of the second connecting portion 460 may form a curved line. The first connecting portion 450 and the second connecting portion 460 may have shapes that correspond to each other.

Figure 18:
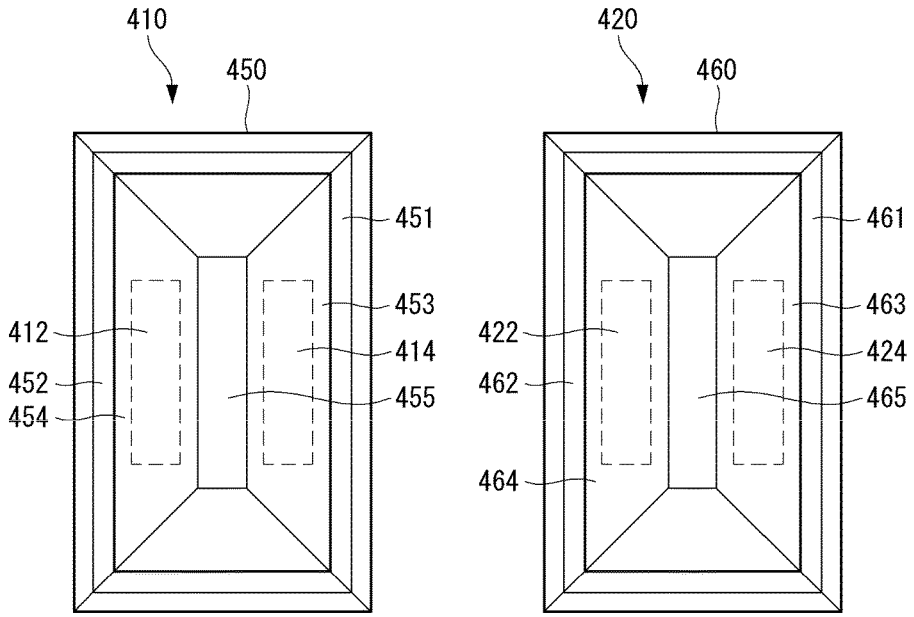
FIG. 18 to FIG. 22 are views of a side of a speaker unit according to an embodiment.
Figure 19:
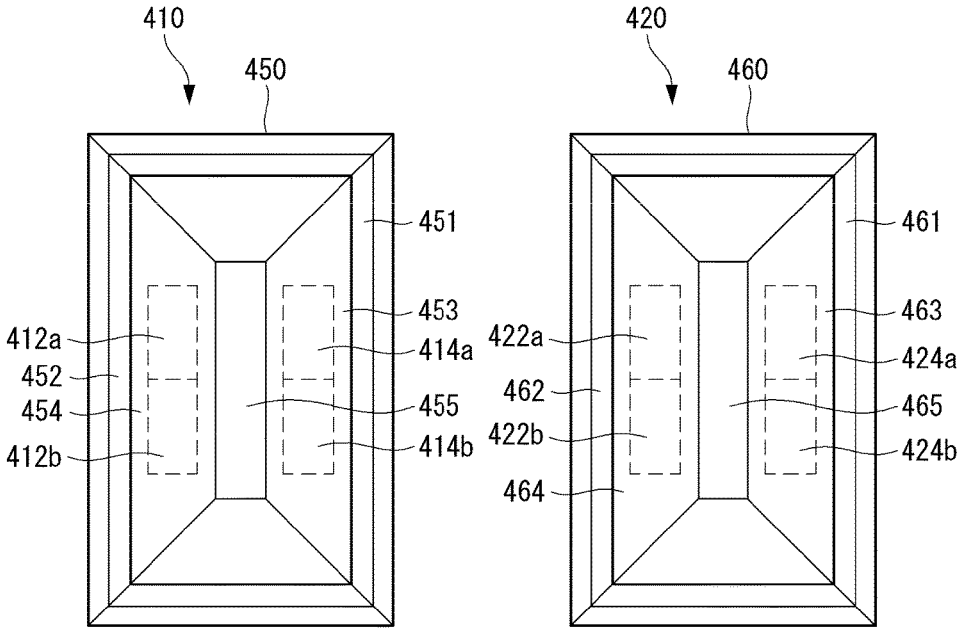
Figure 20:
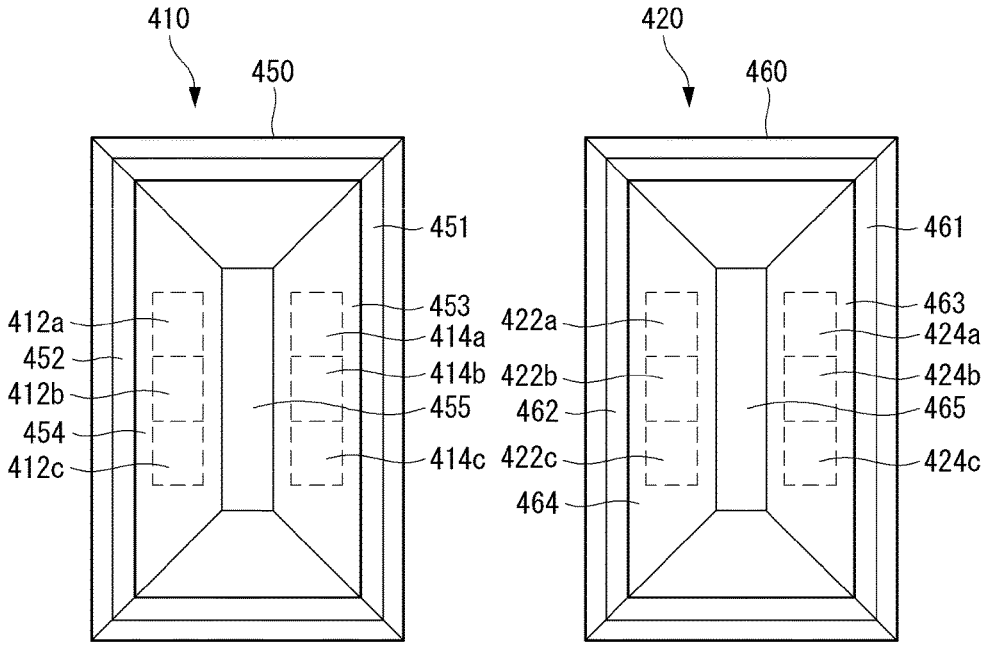

FIGS. 18 to 20 are views of a side of a speaker unit according to the embodiment. The side of the speaker unit may be the side including surfaces of the connecting portions. Referring to FIG. 18, the first magnetic bodies 412 and 414 may be positioned at the first connecting portion 450. The first magnetic bodies 412 and 414 may be positioned inside the first connecting portion 450. The first magnetic bodies 412 and 414 may be positioned on the third surface 453 or the fourth surface 454. The first magnetic bodies 412 and 414 may be a plurality of magnetic bodies. One of the plurality of first magnetic bodies 412 and 414, for example, 414, may be positioned on the third surface 453, and another first magnetic body, for example, 412, may be positioned on the fourth surface 454. The first magnetic body 414 and the first magnetic body 412 may be symmetric to each other with respect to the fifth surface 455.

The second magnetic bodies 422 and 424 may be positioned at the second connecting portion 460. The second magnetic bodies 422 and 424 may be positioned inside the second connecting portion 460. The second magnetic bodies 422 and 424 may be positioned on the third surface 463 or the fourth surface 464. The second magnetic bodies 422 and 424 may be in the plural. One of the plurality of second magnetic bodies 422 and 424, for example, 424, may be positioned on the third surface 463, and other second magnetic body, for example, 422, may be positioned on the fourth surface 464. The second magnetic body 424 and the second magnetic body 422 may be symmetric to each other with respect to the fifth surface 465. For example, the first magnetic body 412 may be S-pole, and the second magnetic body 424 may be N-pole. Further, the first magnetic body 414 may be S-pole, and the second magnetic body 422 may be N-pole.

Referring to FIG. 19, each of the first magnetic bodies 412 and 414 may form a set. Each set may include magnetic bodies each having a different magnetic polarity. For example, the first magnetic bodies 412 and 414 may include first sub-magnetic bodies 412*a* and 414*a* and second sub-magnetic bodies 412*b* and 414*b*. The first sub-magnetic bodies 412*a* and 414*a* and the second sub-magnetic bodies 412*b* and 414*b* may have different magnetic polarities. The first sub-magnetic bodies 412*a* and 414*a* and the second sub-magnetic bodies 412*b* and 414*b* may be alternately provided.

The sets of the first magnetic bodies 412 and 414, each of which includes the sub-magnetic bodies each having the different magnetic polarity, may increase a magnetic flux. In other words, the sets of the first magnetic bodies 412 and 414 may increase a magnetic force. Further, the sets of the first magnetic bodies 412 and 414 may reduce a range of a magnetic field. The sets of the first magnetic bodies 412 and 414 may reduce the range of the magnetic field while increasing a magnetic flux density. Thus, a coupling force between the magnetic bodies may increase. When the magnetic bodies are separated from each other by a predetermined distance, an influence of the magnetic field may be minimized. The above description of the sets of first magnetic bodies 412 and 414 may be equally applied to sets of the second magnetic bodies 422 and 424. For example, the sub-magnetic body 412*a* may be S-pole, and the sub-magnetic body 412*b* may be N-pole. The sub-magnetic body 414*a* may be S-pole, and the sub-magnetic body 414*b* may be N-pole. Further, a sub-magnetic body 422*a* may be N-pole, and a sub-magnetic body 422*b* may be S-pole. A sub-magnetic body 424*a* may be N-pole, and a sub-magnetic body 424*b* may be S-pole.

Referring to FIG. 20, each of the first magnetic bodies 412 and 414 may form a set. Each set may include magnetic bodies having different magnetic polarities. For example; the first magnetic bodies 412 and 414 may include first sub-magnetic bodies 412*a* and 414*a*, second sub-magnetic bodies 412*b* and 414*b*, and third sub-magnetic bodies 412*c* and 414*c*. The first sub-magnetic bodies 412*a* and 414*a* and the second sub-magnetic bodies 412*b* and 414*b* may have different magnetic polarities, and the second sub-magnetic bodies 412*b* and 414*b* and the third sub-magnetic bodies 412*c* and 414*c* may have different magnetic polarities. The plurality of sub-magnetic bodies may be alternately provided.

The sets of the first magnetic bodies 412 and 414, each of which includes the sub-magnetic bodies having the different magnetic polarities, may increase the magnetic flux. In other words, the sets of the first magnetic bodies 412 and 414 may further increase the magnetic force. Further, the sets of the first magnetic bodies 412 and 414 may reduce the range of a magnetic field. The sets of the first magnetic bodies 412 and 414 may further reduce the range of the magnetic field while further increasing the magnetic flux density. Thus, the coupling force between the magnetic bodies may further increase. When the magnetic bodies are separated from each other by a predetermined distance; the influence of the magnetic field may be minimized. The above description of the sets of first magnetic bodies 412 and 414 may be equally applied to sets of the second magnetic bodies 422 and 424. For example, the sub-magnetic body 412*a* may be S-pole, the sub-magnetic body 412*b* may be N-pole, and the sub-magnetic body 412*c* may be S-pole. The sub-magnetic body 414*a* may be S-pole, the sub-magnetic body 414*b* may be N-pole, and the sub-magnetic body 414*c* may be S-pole. Further, a sub-magnetic body 422*a* may be N-pole, a sub-magnetic body 422*b* may be S-pole, and a sub-magnetic body 422*c* may be N-pole. A sub-magnetic body 424*a* may be N-pole, a sub-magnetic body 424*b* may be S-pole, and a sub-magnetic body 424*c* may be N-pole.

Figure 21:
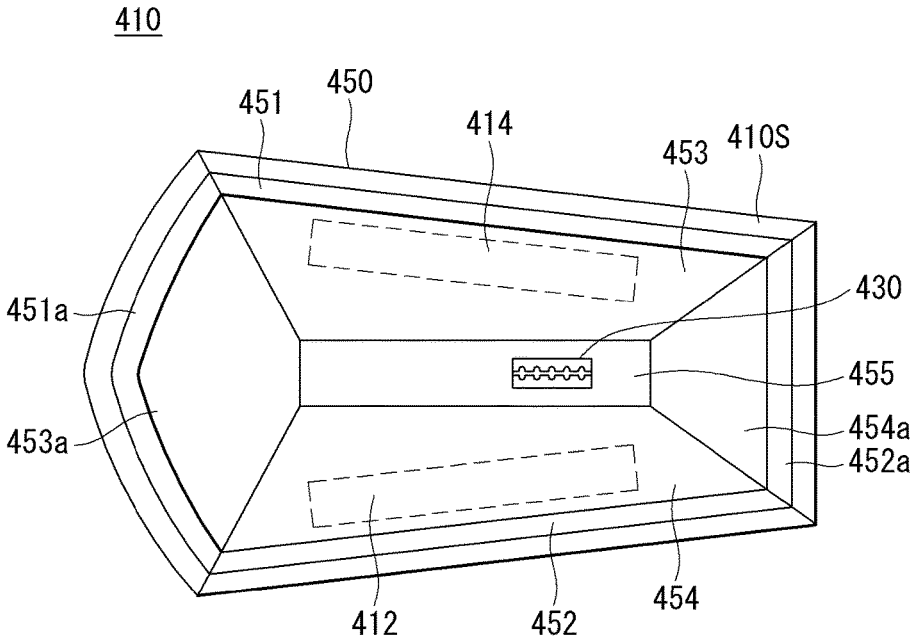
Figure 22:
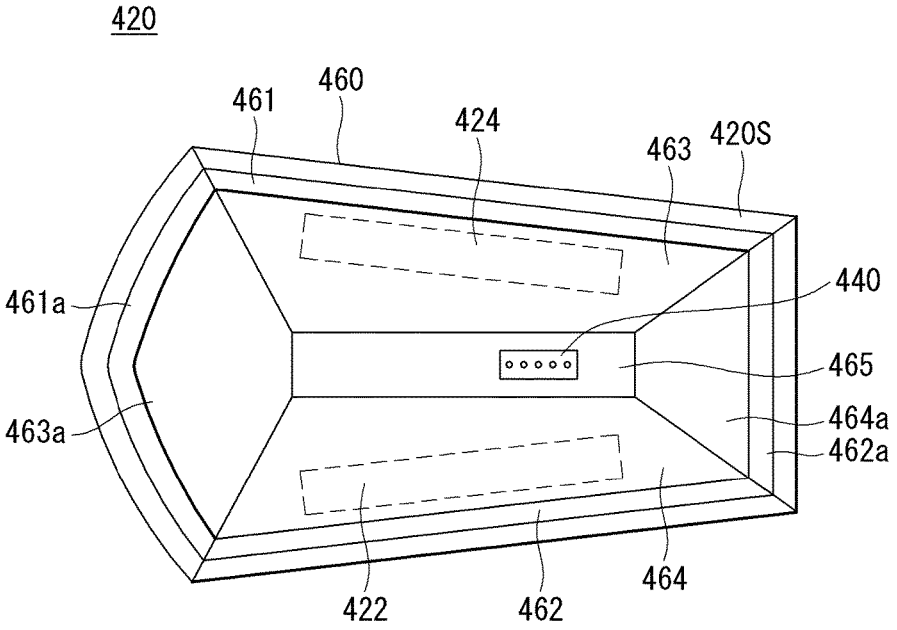

FIGS. 21 and 22 illustrate examples of the side of a speaker unit according to the embodiment of the disclosure. Referring to FIG. 21, one side surface 410S of the first speaker unit 410 may be positioned at the outside of the first connecting portion 450. The one side surface 410S of the first speaker unit 410 may form the outside of the first connecting portion 450. In this instance, the outside may be an edge of the first connecting portion 450.

A first surface 451 may start from the edge of the first connecting portion 450. A second surface 452 may start from the edge of the first connecting portion 450. The first surface 451 and the second surface 452 may be symmetric to each other with respect to a fifth surface 455. The first surface 451 or the second surface 452 may protrude from the edge of the first connecting portion 450 to the outside of the first speaker unit 410 at an inclination. A third surface 453 may start from the first surface 451 and may extend to the fifth surface 455. A fourth surface 454 may start from the second surface 452 and may extend to the fifth surface 455. The third surface 453 and the fourth surface 454 may be symmetric to each other with respect to the fifth surface 455. The third surface 453 or the fourth surface 454 may be depressed towards the inside of the first speaker unit 410 at an inclination. The fifth surface 455 may form a bottom.

The configuration of the first surface 451 or the second surface 452 may be applied to a seventh surface 451*a* and an eighth surface 452*a*. The configuration of the third surface 453 or the fourth surface 454 may be applied to a ninth surface 453*a* and a tenth surface 454*a*. The first surface 451, the second surface 452, the seventh surface 451*a*, and the eighth surface 452*a* may form a ring-shaped perimeter of the first connecting portion 450. The first surface 451, the second surface 452, the seventh surface 451*a*, and the eighth surface 452*a* may form an angular pipe line at the perimeter of the first connecting portion 450. The first surface 451, the second surface 452, the seventh surface 451*a*, and the eighth surface 452*a* may form a male thread shape of screw at the perimeter of the first connecting portion 450.

The third surface 453, the fourth surface 454, the ninth surface 453*a*, and the tenth surface 454*a* may form a sunken area in a middle of the first connecting portion 450. The third surface 453, the fourth surface 454, the ninth surface 453*a*, and the tenth surface 454*a* may form a downwardly depressed area in the middle of the first connecting portion 450. The fifth surface 455 may firm a bottom of the sunken area or the downwardly depressed area. The sunken area may be referred to as a sunken surface. In other words, the first connecting portion 450 may include the first to tenth surfaces 451 to 454*a*. Thus, the first connecting portion 450 may protrude from the edge of the first speaker unit 410 toward the outside of the first speaker unit 410 at an inclination and may be depressed toward the inside of the first speaker unit 410 at an inclination. The first connecting portion 450 may have a crater shape.

Referring to FIG. 22, one side surface 420S of the second speaker unit 420 may be positioned at the outside of the second connecting portion 460. The one side surface 420S of the second speaker unit 420 may form the outside of the second connecting portion 460. In this instance, the outside may be an edge of the second connecting portion 460. A first surface 461 may start from the edge of the second connecting portion 460. A second surface 462 may start from the edge of the second connecting portion 460. The first surface 461 and the second surface 462 may be symmetric to each other with respect to a fifth surface 465. The first surface 461 or the second surface 462 may be depressed from the edge of the second connecting portion 460 to the inside of the second speaker unit 420 at an inclination.

A third surface 463 may start from the first surface 461 and may extend to the fifth surface 465. A fourth surface 464 may start from the second surface 462 and may extend to the fifth surface 465. The third surface 463 and the fourth surface 464 may be symmetric to each other with respect to the fifth surface 465. The third surface 463 or the fourth surface 464 may protrude to the outside of the second speaker unit 420 at an inclination. The fifth surface 465 may form a summit. The configuration of the first surface 461 or the second surface 462 may be applied to a seventh surface 461*a* and an eighth surface 462*a*. The configuration of the third surface 463 or the fourth surface 464 may be applied to a ninth surface 463*a* and a tenth surface 464*a*.

The first surface 461, the second surface 462, the seventh surface 461*a*, and the eighth surface 462*a* may form a ring-shaped perimeter of the second connecting portion 460. The first surface 461, the second surface 462, the seventh surface 461*a*, and the eighth surface 462*a* may form a depressed pipe line at the perimeter of the second connecting portion 460. The first surface 461, the second surface 462, the seventh surface 461*a*, and the eighth surface 462*a* may form a female thread shape of screw at the perimeter of the second connecting portion 460.

The third surface 463, the fourth surface 464, the ninth surface 463*a*, and the tenth surface 464*a* may form an uplifted area in a middle of the second connecting portion 460. The third surface 463, the fourth surface 464, the ninth surface 463*a*, and the tenth surface 464*a* may form a protruded area in the middle of the second connecting portion 460. The fifth surface 465 may firm an upper surface of the uplifted area or the protruded area. The uplifted area may be referred to as an uplifted surface. In other words, the second connecting portion 460 may include the first to tenth surfaces 461 to 464*a*. Thus, the second connecting portion 460 may be depressed from the outside of the second speaker unit 420 toward the inside of the second speaker unit 420 at an inclination and may again protrude toward the outside of the second speaker unit 420 at an inclination. The second connecting portion 460 may have a dome shape.

Figure 23:
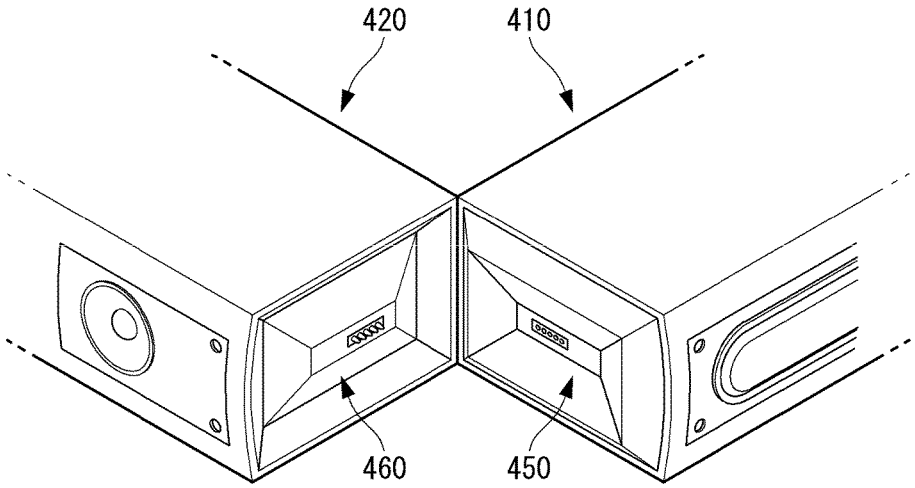
FIG. 23 and FIG. 24 are views of coupling components of a speaker assembly according to an embodiment.
Figure 24:
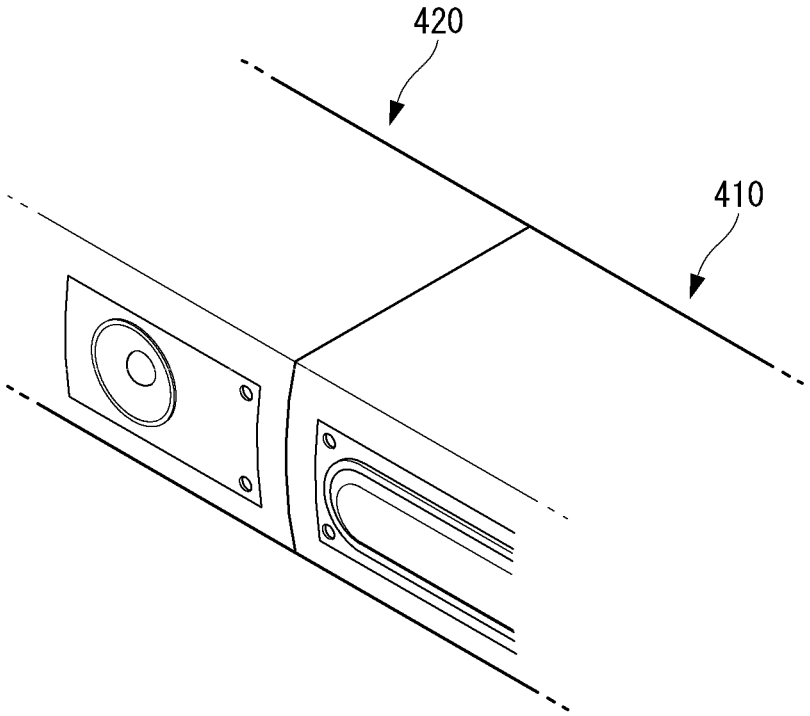

FIGS. 23 and 24 are views of coupling the components of the speaker assembly according to the embodiment. An entire shape of the first connecting portion 450 may correspond to an entire shape of the second connecting portion 460. The entire shape of the first connecting portion 450 may be matched to the entire shape of the second connecting portion 460, like a relationship between the male and female threads. Thus, the coupling between the first speaker unit 410 and the second speaker unit 420 may be easily performed at a particular location.

Figure 25:
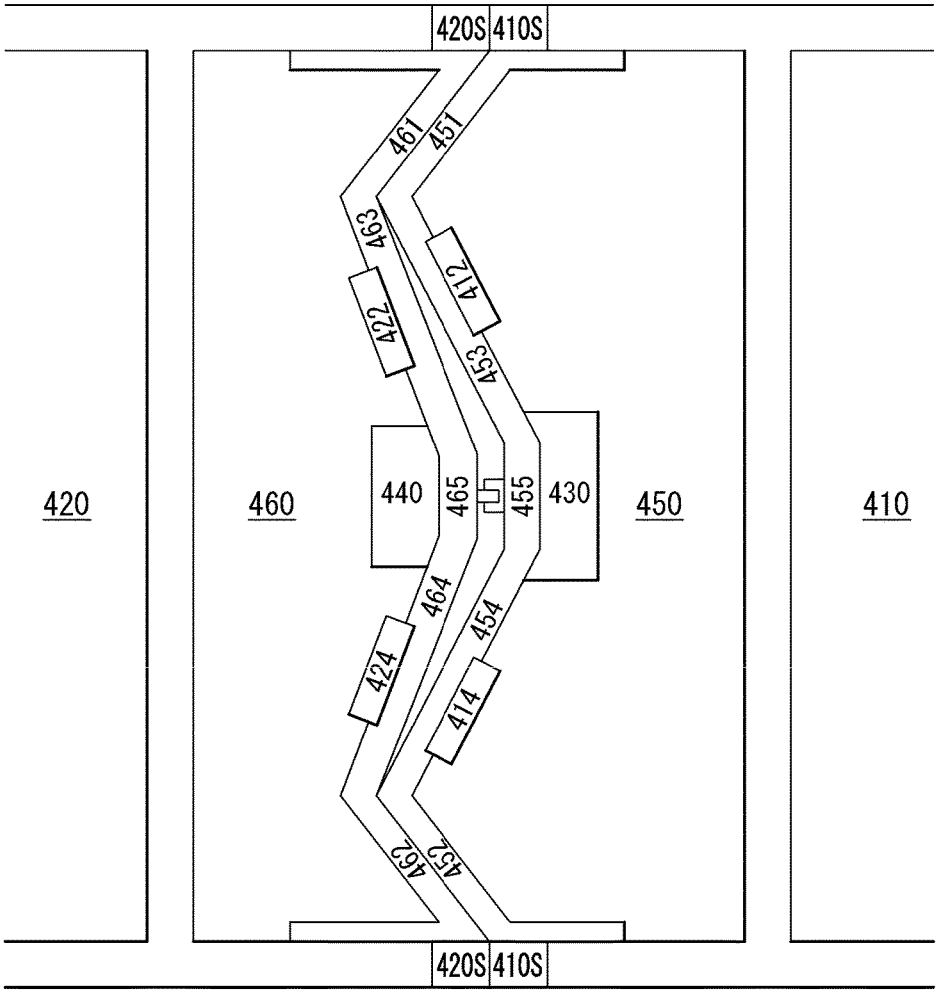
FIG. 25 to FIG. 27 are views of a cross section of a speaker assembly according to an embodiment.
Figure 26:
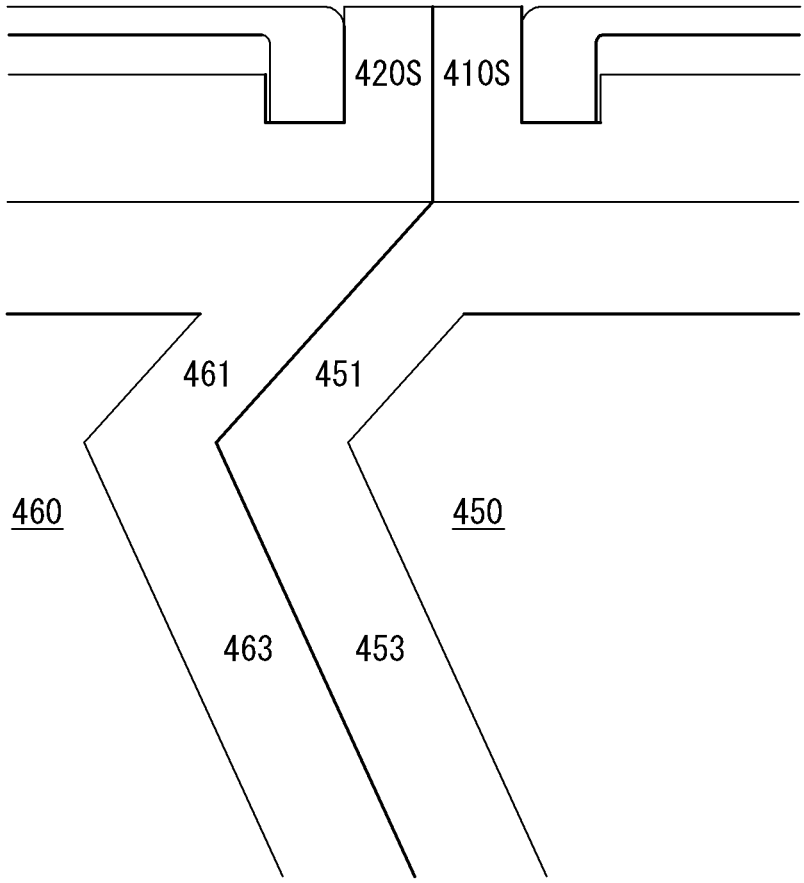
Figure 27:
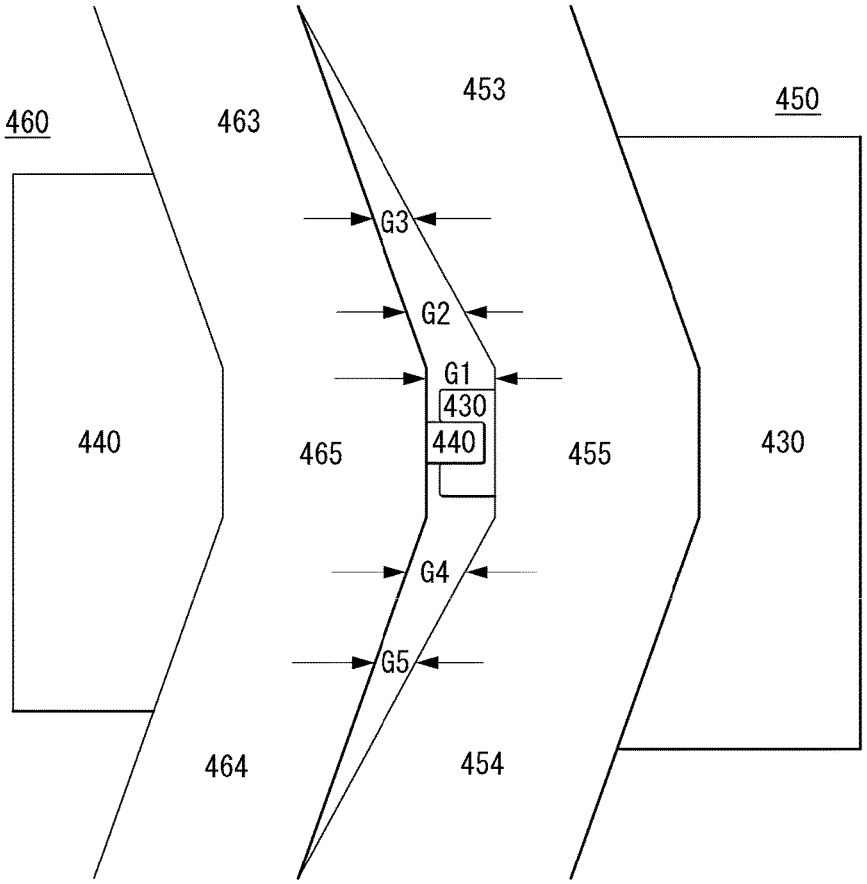

FIGS. 25 to 27 are views of a cross section of the speaker assembly according to the embodiment. Referring to FIGS. 25 and 26, when the first connecting portion 450 is inserted into the second connecting portion 460, the first surface 461 and/or the third surface 463 of the second connecting portion 460 may guide the first surface 451 and/or the third surface 453 of the first connecting portion 450. Thus, the first connecting portion 450 may face the second connecting portion 460. Further, the first connecting portion 450 may contact the second connecting portion 460. The first surface 451 of the first connecting portion 450 may contact the first surface 461 of the second connecting portion 460. A portion of the third surface 453 of the first connecting portion 450 may contact a portion of the third surface 463 of the second connecting portion 460. The first speaker unit 410 may be accurately aligned and coupled with the second speaker unit 420.

Referring to FIGS. 25 and 27, while the first connecting portion 450 is inserted into the second connecting portion 460, the second connector 440 may be inserted into the first connector 430. The above description with respect to the coupling of the first connecting portion 450 and the second connecting portion 460 may be applied so that the second connector 440 is properly and accurately inserted into the first connector 430 without damage.

In FIGS. 25 and 27, a portion of the third surface 453 of the first connecting portion 450 may be separated from a portion of the third surface 463 of the second connecting portion 460. The fifth surface 455 of the first connecting portion 450 may be separated from the fifth surface 465 of the second connecting portion 460. The first connecting portion 450 may be separated from the second connecting portion 460 by a predetermined distance. The predetermined distance may be uniform or non-uniform. For example, the fifth surface 455 of the first connecting portion 450 may be separated from the fifth surface 465 of the second connecting portion 460 by a first distance G1. A portion of the third surface 453 of the first connecting portion 450 may be separated from a portion of the third surface 463 of the second connecting portion 460 by a second distance G2 or a third distance G3. The second distance G2 may be less than the third distance G3. A portion of the fourth surface 454 of the first connecting portion 450 may be separated from a portion of the fourth surface 464 of the second connecting portion 460 by a fourth distance G4 or a fifth distance G5. The fourth distance G4 may be greater than the fifth distance G5. The distance G may indicate a depth in terms of the depressed area and the sunken area. The distance G may indicate a height in terms of the protruded area and the uplifted area. Thus, the first connector 430 and/or the second connector 440 may be prevented from being damaged when the first speaker unit 410 is coupled with the second speaker unit 420.

Figure 28:
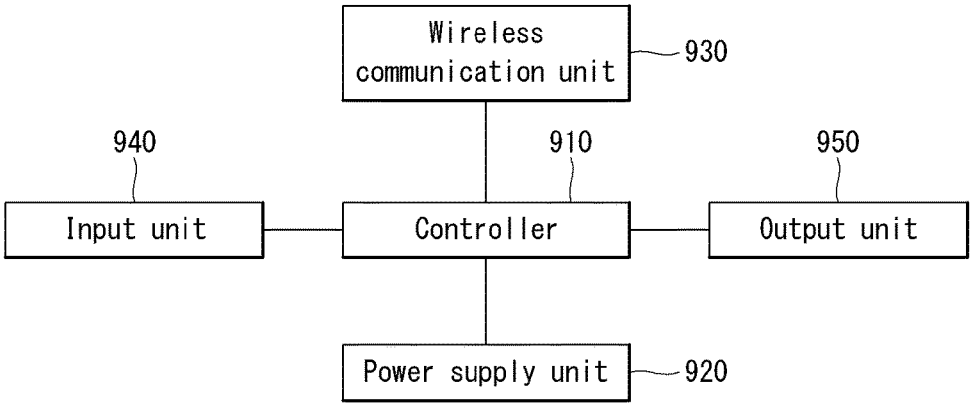
FIG. 28 is a block diagram of a speaker assembly according to an embodiment.

FIG. 28 is a block diagram of the speaker assembly according to the embodiment. A configuration described below may be embedded in the first speaker unit 410 and may be embedded in the second speaker unit 420. The configuration described below may be embedded in each of the first speaker unit 410 and the second speaker unit 420. A wireless communication unit 930 may include one or more modules, which may enable wireless communication between the first speaker unit 410 and/or the second speaker unit 420 and a wireless communication system, between the first speaker unit 410 and the second speaker unit 420, or between the first speaker unit 410 and an external server. Further, the wireless communication unit 930 may include one or more modules connecting the first speaker unit 410 and/or the second speaker unit 420 to one or more networks. The wireless communication unit 930 may include at least one of a broadcast receiving module, a wireless Internet module, a short-range communication module, and a location information module. For example, the wireless communication unit 930 may be Bluetooth or Wi-Fi.

An input unit 940 may include a user input unit, such as, e.g., a touch key, a push key, a mechanical key, a soft key, that allows the user to input information. The input unit 940 may serve as an interface with various types of external devices connected to the first speaker unit 410 or the second speaker unit 420. The input unit 940 may include at least one of wired or wireless headset ports, external power supply ports, wired or wireless data ports, memory card ports, ports for connecting a device having an identification module, audio input/output (I/O) ports, video I/O ports, or earphone ports. For example, the input unit 940 may include the pogo pin described above. A controller 910 may perform assorted control functions associated with a connected external device in response to the external device being connected to the input unit 940.

The input unit 940 may be provided on one side of the second speaker unit 420. The input unit 940 may be provided on one side of the second speaker unit 420 opposite the second connecting portion 460. When the second connecting portion 460 of the second speaker unit 420 supports the second speaker unit 420 toward the bottom, the user may operate the input unit 940 provided on one side exposed to the outside of the second speaker unit 420 and may operate the second speaker unit 420.

A controller 910 may function to control overall operation of the first speaker unit 410 and/or the second speaker unit 420. The controller 910 may process signals, data, and/or information, which may be input or output by the components described above. The controller 910 may control some or all of the components illustrated in FIG. 28. In addition, the controller 910 may combine and operate at least two of the above components.

A power supply unit 920 may receive external power or internal power under the control of the controller 910 and supply power to the components included in the first speaker unit 410 and/or the second speaker unit 420. The power supply unit 920 may include a battery, and the battery may be embedded in the device body, or may be detachable from the device body.

An output unit 950 may be a high frequency speaker, a medium frequency speaker, a medium/low frequency speaker, or a low frequency speaker, which may be included in the first speaker unit 410 and/or the second speaker unit 420. For example, the output unit 950 may be a tweeter or a woofer.

The user may use the first speaker unit 410 and the second speaker unit 420 together. On the other hands, the user may use the second speaker unit 420 separately from the first speaker unit 410. The user may use the second speaker unit 420 while physically separating the second speaker unit 420 from the first speaker unit 410. Further, the user may use the second speaker unit 420 while electrically separating the second speaker unit 420 from the first speaker unit 410. In other words, the second speaker unit 420 may be connected to other electronic device, to which the first speaker unit 410 may not be connected, and may be used. For example, the user may connect the first speaker unit 410 to the display device 10 and may use the first speaker unit 410. In this instance, the first speaker unit 410 may output audio signals of an image displayed on the display device 10. The second speaker unit 420 may be connected to the other electronic device and may be used. In this instance, the second speaker unit 420 may output audio signals received from the other electronic device irrespective of the audio signals of the image displayed on the display device 10.

The first speaker unit 410 and the second speaker unit 420 may be electrically connected to the display device 10, but may be physically separated from each other. Thus, the first speaker unit 410 and the second speaker unit 420 may simultaneously provide audio signals output from the display device 10 to the user.

Embodiments disclosed herein provide a speaker assembly which may include a first speaker unit, a first connecting portion forming a side of the first speaker unit and depressed at the side of the first speaker unit, a first magnetic body positioned at the first connecting portion, a second speaker unit, a second connecting portion forming a side of the second speaker unit and protruding from the side of the second speaker unit to be inserted into the first connecting portion, and a second magnetic body positioned at the second connecting portion and having a magnetic polarity different from the first magnetic body.

The first magnetic body or the second magnetic body may be a plurality of magnetic bodies. The first magnetic body may include a plurality of first sub-magnetic bodies having different magnetic polarities, and the second magnetic body may include a plurality of second sub-magnetic bodies having different magnetic polarities. The plurality of first sub-magnetic bodies and the plurality of second sub-magnetic bodies may be alternately provided and may provide an attractive force between the first connecting portion and the second connecting portion.

The first connecting portion may include a protrusion protruding from an edge of the first connecting portion toward the outside of the first speaker unit at an inclination, and a depression depressed from the protrusion toward the inside of the first speaker unit at the inclination. The second connecting portion may include a depression depressed from an edge of the second connecting portion toward the inside of the second speaker unit at the inclination, and a protrusion protruding from the depression toward the outside of the second speaker unit at the inclination. The inclination may be in a range of about 30° to 60°.

The speaker assembly may further include a first connector installed at the first speaker unit and exposed to the outside of the first connecting portion, and a second connector installed at the second speaker unit and exposed to the outside of the second connecting portion. The first connector may be electrically connected to the second connector when the first speaker unit is coupled with the second speaker unit.

The first connecting portion may have a surface sunken to the inside of the first speaker unit, and the second connecting portion may have a surface uplifted to the outside of the second speaker unit. The first connector may be positioned at a bottom of the sunken surface, and the second connector may be positioned at a summit of the uplifted surface.

The first connecting portion may have a surface having an inclination different from an inclination direction of the sunken surface at an edge of the sunken surface. The second connecting portion may have a surface having the inclination different from an inclination direction of the uplifted surface at an edge of the uplifted surface. The inclination may be in a range of about 30° to 60°.

When the first connecting portion is fastened to the second connecting portion through the first and second magnetic bodies, the summit may be separated from the bottom. A depressed depth of the first connecting portion may be greater than a protruding height of the second connecting portion. The first connecting portion may entirely have a crater shape, and the second connecting portion may entirely have a dome shape.

Embodiments disclosed herein provide a display device which may include a display head including a display panel and a speaker assembly positioned to be separated from the display head, wherein the speaker assembly includes a first speaker unit, a first connecting portion forming a side of the first speaker unit, a second speaker unit, a second connecting portion forming a side of the second speaker unit, a first magnetic body included in the first connecting portion; and a second magnetic body included in the second connecting portion and having a magnetic polarity different from the first magnetic body, wherein the first connecting portion has an inclined surface toward the outside of the first speaker unit at an edge of the first connecting portion and includes a depression, of which at a least a portion is sunken, wherein the second connecting portion has an inclined surface toward the inside of the second speaker unit at an edge of the second connecting portion and includes a protrusion; of which at a least a portion is uplifted. The display head may be used to be distinguished from the speaker assembly. The display head may be referred to as a body, a display, a display unit, or a display panel.

The display device may further include a first connector embedded in the first speaker unit, positioned at a bottom of the depression, and exposed to the outside of the first connecting portion, and a second connector embedded in the second speaker unit, positioned at a summit of the protrusion, and exposed to the outside of the second connecting portion.

The first magnetic body may include a plurality of first sub-magnetic bodies which have different magnetic polarities and are alternately disposed. The second magnetic body may include a plurality of second sub-magnetic bodies which have different magnetic polarities and are alternately disposed so that an attractive force may be provided between the plurality of first sub-magnetic bodies and the plurality of second sub-magnetic bodies. A sinking depth of the depression may be greater than an uplifted height of the protrusion in a state where the first speaker unit is coupled with the second speaker unit. The inclined surfaces of the first and second connecting portions may have an inclination in a range of about 30° to 60°.

Embodiments disclosed herein provide a speaker assembly including a first speaker having a front to output sound, the front being provided between first and second sides, the first side having a recess of a first prescribed contour, a plurality of first magnets provided at the recess, a second speaker having a front to output sound, the front being provided between first and second sides, the second side having a protrusion of a second prescribed contour and configured to couple with the first side of the first speaker, and a plurality of second magnets provided at the protrusion, each of the plurality of second magnets having a magnetic polarity different from a magnetic polarity of a respective first magnet of the plurality of first magnets.

The terms 'first', 'second', etc. may be used to describe various components, but the components are not limited by such terms. The terms are used only for the purpose of distinguishing one component from other components. For example, a first component may be designated as a second component without departing from the scope of the present disclosure. In the same manner, the second component may be designated as the first component. The term "and/or" encompasses both combinations of the plurality of related items disclosed and any item from among the plurality of related items disclosed.

When an arbitrary component is described as "being connected to" or "being linked to" another component, this should be understood to mean that still another component(s) may exist between them, although the arbitrary component may be directly connected to, or linked to, the second component. In contrast, when an arbitrary component is described as "being directly connected to" or "being directly linked to" another component, this should be understood to mean that no component exists between them.

The terms "include" and "have" should be understood to be intended to designate that illustrated features, numbers, steps, operations; components, parts or combinations thereof exist and not to preclude the existence of one or more different features, numbers, steps, operations, components, parts or combinations thereof, or the possibility of the addition thereof.

Embodiments of the disclosure have been described using an organic light emitting diode (OLED) display panel as an example of a display panel. Other display panels may be used. For example, a liquid crystal display panel (LCD) panel, a plasma display panel (PDP), and a field emission display (FED) panel may be used.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A speaker assembly, comprising:

a first speaker;

a first connecting portion that is depressed at a side of the first speaker;

a first magnetic body provided at the first connecting portion;

a second speaker;

a second connecting portion that protrudes from a side of the second speaker and configured to be inserted into the first connecting portion; and a second magnetic body provided at the second connecting portion and having a magnetic polarity different from a magnetic polarity of the first magnetic body, wherein the first connecting portion includes:

a protrusion that protrudes adjacent to an edge of the first connecting portion toward an outside of the first speaker at an inclination; and a depression depressed from the protrusion toward an inside of the first speaker at the inclination, and wherein the second connecting portion includes:

a depression depressed adjacent to an edge of the second connecting portion toward an inside of the second speaker at the inclination; and a protrusion that protrudes from the depression toward an outside of the second speaker at the inclination.

2. The speaker assembly of claim 1, wherein at least one of the first magnetic body or the second magnetic body is a plurality of magnetic bodies.

3. The speaker assembly of claim 1, wherein the first magnetic body includes a plurality of first sub-magnetic bodies having different magnetic polarities, the second magnetic body includes a plurality of second sub-magnetic bodies having different magnetic polarities, and the plurality of first sub-magnetic bodies and the plurality of second sub-magnetic bodies are alternately provided and provide an attractive force to couple the first connecting portion and the second connecting portion.

4. The speaker assembly of claim 1, wherein the inclination is in a range of about 30° to 60°.

5. The speaker assembly of claim 1, further including:

a first connector installed at the first speaker and exposed to an outside of the first connecting portion; and a second connector installed at the second speaker and exposed to an outside of the second connecting portion, wherein the first connector is electrically connected to the second connector when the first speaker is coupled with the second speaker.

6. The speaker assembly of claim 5, wherein the first connector is provided at a bottom of a sunken surface of the first connecting portion that is sunken into an inside of the first speaker, and the second connector is provided at a summit of an uplifted surface of the second connecting portion that is raised towards an outside of the second speaker.

7. The speaker assembly of claim 6, wherein the first connecting portion includes a surface having an inclination different from an inclination direction of the sunken surface at an edge of the sunken surface, and the second connecting portion includes a surface having an inclination different from an inclination direction of the uplifted surface at an edge of the uplifted surface.

8. The speaker assembly of claim 7, wherein the inclination is in a range of about 30° to 60°.

9. The speaker assembly of claim 6, wherein when the first connecting portion is coupled to the second connecting portion through the first and second magnetic bodies, the summit is separated from the bottom.

10. The speaker assembly of claim 1, wherein a depression depth of the first connecting portion is greater than a protrusion height of the second connecting portion.

11. The speaker assembly of claim 1, wherein the first connecting portion is formed in a crater shape, and the second connecting portion is formed in a dome shape.

12. A display device, comprising:

a display head including a display panel; and a speaker assembly configured to be separated from the display head, the speaker assembly including:

a first speaker;

a first connecting portion that forms a side of the first speaker;

a second speaker;

a second connecting portion that forms a side of the second speaker;

a first magnetic body provided at the first connecting portion; and a second magnetic body provided at the second connecting portion and having a magnetic polarity different from a magnetic polarity of the first magnetic body, wherein the first connecting portion includes an inclined surface, which is inclined toward an outside of the first speaker at an edge of the first connecting portion, and a depression, of which at a least a portion is sunken, and wherein the second connecting portion includes an inclined surface, which is inclined toward an inside of the second speaker at an edge of the second connecting portion, and a protrusion, of which at a least a portion is uplifted.

13. The display device of claim 12, further including:

a first connector embedded in the first speaker, provided at a bottom of the depression, and exposed to an outside of the first connecting portion; and a second connector embedded in the second speaker, provided at a summit of the protrusion, and exposed to an outside of the second connecting portion.

14. The display device of claim 12, wherein the first magnetic body includes a plurality of first sub-magnetic bodies, which have different magnetic polarities and are alternately provided, and the second magnetic body includes a plurality of second sub-magnetic bodies, which have different magnetic polarities and are alternately provided, such that the plurality of first sub-magnetic bodies and the plurality of second sub-magnetic bodies are attracted to each other.

15. The display device of claim 12, wherein a depth of the depression is greater than a height of the protrusion when the first speaker is coupled with the second speaker.

16. The display device of claim 12, wherein the inclined surfaces of the first and second connecting portions each have an inclination angle in a range of about 30° to 60°.

* * * * *